US005635322A

United States Patent [19]

Zwartz et al.

[11] Patent Number: 5,635,322

[45] Date of Patent: Jun. 3, 1997

[54] PROCESS FOR DEVELOPING AND OVERCOATING MIGRATION IMAGING MEMBERS

[75] Inventors: Edward G. Zwartz, Mississauga; Heidi Pinkney, Hamilton, both of Canada

[73] Assignee: Xerox Corportion, Stamford, Conn.

[21] Appl. No.: 559,966

[22] Filed: Nov. 17, 1995

[51] Int. Cl.[6] ..... G06G 13/70; G06G 13/78

[52] U.S. Cl. ..... 430/41; 430/124

[58] Field of Search ..... 430/41, 126, 66, 430/124

[56] References Cited

U.S. PATENT DOCUMENTS

| | | | |
|---|---|---|---|
| 3,741,758 | 6/1973 | Chrzanowski et al. | 96/1 R |
| 3,901,702 | 8/1975 | Sankus, Jr. et al. | 96/1.5 |
| 3,909,262 | 9/1975 | Goffe et al. | 96/1.5 |
| 4,007,042 | 2/1977 | Buckley et al. | 96/1 PS |
| 4,021,110 | 5/1977 | Pundsack | 355/10 |
| 4,496,642 | 1/1985 | Tam et al. | 430/41 |
| 4,536,457 | 8/1985 | Tam | 430/41 |
| 4,536,458 | 8/1985 | Ng | 430/41 |
| 5,021,318 | 6/1991 | Mayo et al. | 430/124 |
| 5,102,756 | 4/1992 | Vincett et al. | 430/41 |
| 5,215,838 | 6/1993 | Tam et al. | 430/41 |
| 5,411,825 | 5/1995 | Tam | 430/41 |

*Primary Examiner*—John Goodrow
*Attorney, Agent, or Firm*—Judith L. Byorick

[57] ABSTRACT

Disclosed is a process which comprises (1) providing a migration imaging member comprising a substrate and a softenable layer comprising a softenable material and a photosensitive migration marking material; (2) uniformly charging the imaging member; (3) subsequent to step (2), exposing the charged imaging member to activating radiation at a wavelength to which the migration marking material is sensitive; (4) subsequent to step (3), applying to the surface of the migration imaging member spaced from the substrate a substantially transparent overcoating layer and applying heat and pressure to the migration imaging member and overcoating layer, thereby causing the softenable material to soften and enabling the migration marking material to migrate through the softenable material toward the substrate in an imagewise pattern, while substantially simultaneously causing the overcoating layer to adhere to the imaging member surface.

12 Claims, 12 Drawing Sheets

FIG. 9A
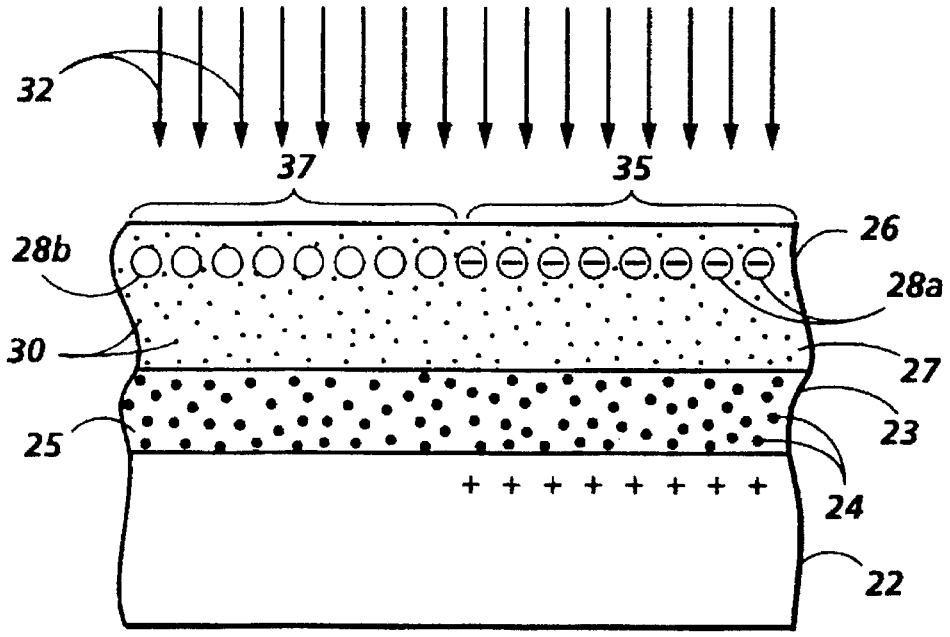
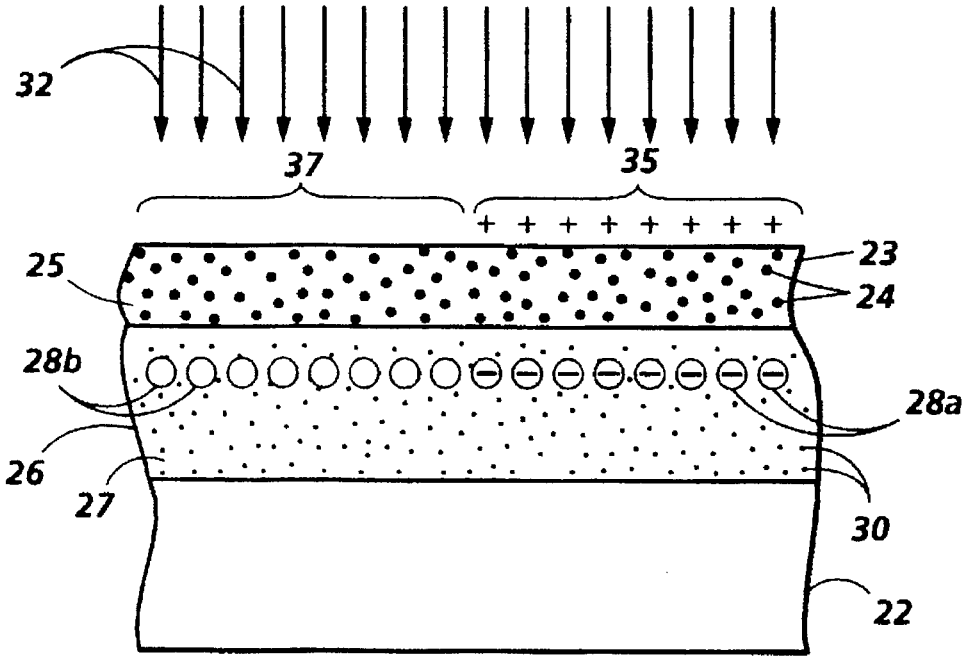
FIG. 9B

FIG. 12A
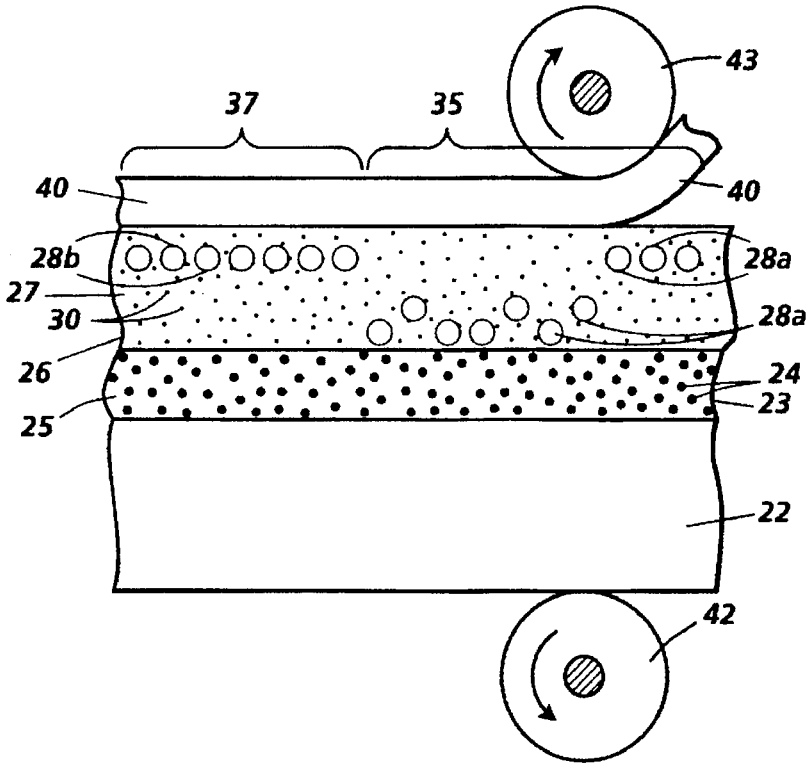
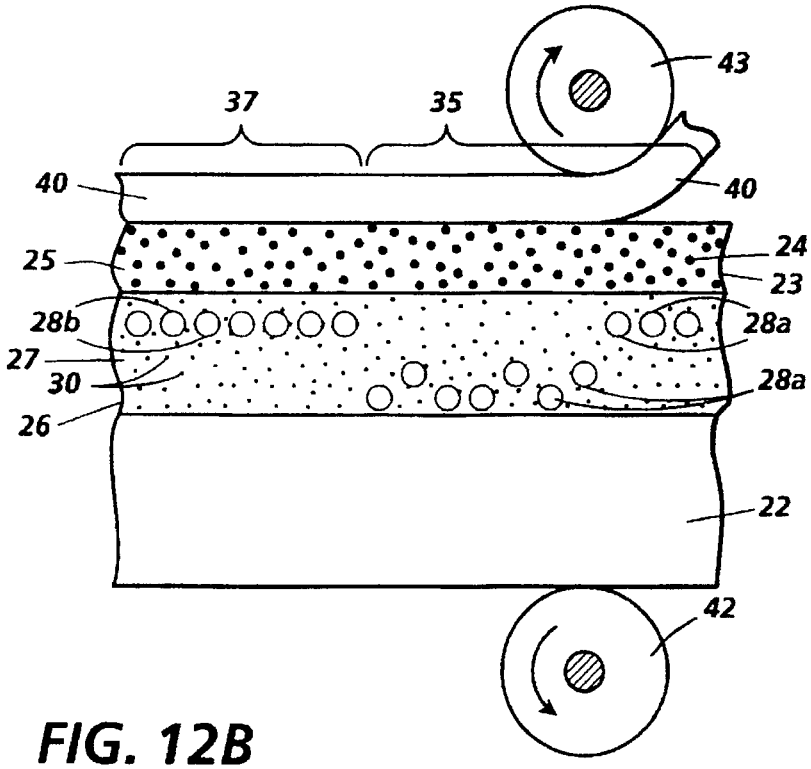
FIG. 12B

PROCESS FOR DEVELOPING AND OVERCOATING MIGRATION IMAGING MEMBERS

BACKGROUND OF THE INVENTION

The present invention is directed to a process for developing and overcoating migration imaging members. More specifically, the present invention is directed to a process for simultaneously developing a latent image in a migration imaging member and applying thereto a protective layer. One embodiment of the present invention is directed to a process which comprises (1) providing a migration imaging member comprising a substrate and a softenable layer comprising a softenable material and a photosensitive migration marking material; (2) uniformly charging the imaging member; (3) subsequent to step (2), exposing the charged imaging member to activating radiation at a wavelength to which the migration marking material is sensitive; (4) subsequent to step (3), applying to the surface of the migration imaging member spaced from the substrate a substantially transparent overcoating layer and applying heat and pressure to the migration imaging member and overcoating layer, thereby causing the softenable material to soften and enabling the migration marking material to migrate through the softenable material toward the substrate in an imagewise pattern, while substantially simultaneously causing the overcoating layer to adhere to the imaging member surface.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 47 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. Nos. 4,536,458 and 4,536,457.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

U.S. Pat. No. 5,021,318 (Mayo et al.), the disclosure of which is totally incorporated herein by reference, discloses a process for forming secure images which comprises electrostatically charging an imaging member, imagewise exposing the charged member, thereby forming a latent image on the member, developing the latent image with a liquid developer comprising a liquid medium, a charge control additive, and toner particles comprising a colorant and a polymeric material, allowing the developed image to dry on the imaging member, contacting the portion of the imaging member with the dry developed image with a substantially transparent sheet having an adhesive material on the surface thereof in contact with the imaging member, thereby transferring the developed image from the imaging member to the substantially transparent sheet, contacting the adhesive surface of the substantially transparent sheet with the developed image with a paper sheet having a polymeric coating on the surface that is in contact with the substantially transparent sheet, and applying heat and pressure to the substantially transparent sheet and the paper sheet at a temperature and pressure sufficient to affix the image permanently to the paper. The resulting document is a paper sheet covered with the transparent sheet, with the developer material that forms the image being situated between the paper sheet and the transparent sheet. The disclosed process is generally useful for applications such as passport photographs, identification badges, banknote paper, and the like.

U.S. Pat. No. 4,496,642 (Tam et al.), the disclosure of which is totally incorporated herein by reference, discloses an imaging member comprising a substrate, an electrically insulating swellable, softenable layer on the substrate, the softenable layer having particulate migration marking material located at least at or near the surface of the softenable layer spaced from the substrate, and a protective overcoating comprising a film forming resin, a portion of which extends beneath the surface of the softenable layer. This migration imaging member may be prepared with the aid of a material which swells at least the surface of the softenable layer to allow the film forming resin to penetrate beneath the surface of the softenable layer.

U.S. Pat. No. 4,021,110 (Pundsack), the disclosure of which is totally incorporated herein by reference, discloses a camera/processor for continuously exposing and developing photographic migration imaging film. The apparatus can perform either heat or meniscus development and, optionally, film overcoating. After the film is exposed, it travels along a predetermined path, which path may include a plurality of separate film developing and film drying stations, toward a takeup reel.

U.S. Pat. No. 4,007,042 (Buckley et al.), the disclosure of which is totally incorporated herein by reference, discloses a migration imaging system including imaging members comprising a substrate overcoated with a softenable layer, and migration marking material, with the softenable layer having a thin surface skin of material having a higher viscosity than the remainder of the softenable material layer.

U.S. Pat. No. 3,901,702 (Sankus, Jr. et al.), the disclosure of which is totally incorporated herein by reference, discloses a migration imaging system having a migration imaging member comprising a softenable layer, migration material and an absorbent blotter member, which imaging member may be imaged by forming a latent image on said member, softening the softenable layer and removing residual materials by removing the absorbent blotter member.

U.S. Pat. No. 3,909,262 (Goffe et al.), the disclosure of which is totally incorporated herein by reference, discloses a migration imaging system wherein migration imaging members typically comprising a substrate, a layer of softenable material, and migration marking material, additionally contain one or more overlayers of material to produce improved results in the imaging system. The overlayer may variously comprise another layer of softenable material, a layer of material which is harder than the softenable material layer, or a gelatin layer.

U.S. Pat. No. 3,741,758 (Chrzanowski et al.), the disclosure of which is totally incorporated herein by reference discloses a process for removing background from a migration imaged member comprising a layer of softenable material and migration material selectively distributed in depth in said softenable material with some background material, by extruding away the background material and contiguous portions of softenable material, for example, by passing the migration imaged member through a pressure nip wherein some of the softenable material is extruded in front of the nip carrying with it the unmigrated particles.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

Copending application U.S. Ser. No. 08/353,461 now U.S. Pat. No. 5,576,129, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Liraburg, the disclosure of which is totally incorporated herein by reference, discloses a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

Copending application U.S. Ser. No. 08/413,667 now U.S. Pat. No. 5,532,102, entitled "Improved Apparatus and Process for Preparation of Migration Imaging Members", filed Mar. 30, 1995 with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

Copending application U.S. Ser. No. 08/432,401 now U.S. Pat. No. 5,563,013, Kentitled "PreSensitized Infrared or Red Light Sensitive Migration Imaging Members", filed May 1, 1995 with the named inventor Man C. Tam, the disclosure of which is totally incorporated herein by reference, discloses a process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

Copending application U.S. Ser. No. 08/432,291 pending, entitled "Improved Migration Imaging Process", filed May 1, 1995 with the named inventors Man C. Tam and Edward G. Zwartz, the disclosure of which is totally incorporated herein by reference, discloses a process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern, thereby forming an electrostatic latent image on the imaging member; and (e) subsequent to steps (c) and (d), causing the softenable material to soften, thereby enabling the migration marking material to migrate through the softenable material toward the substrate in an imagewise pattern.

Copending application U.S. Ser. No. 08/432,448 pending, entitled "Improved Overcoated Migration Imaging Members", filed May 1, 1995 with the named inventors Shadi L. Malhotra and Arthur Y. Jones, the disclosure of which is totally incorporated herein by reference, discloses a migration imaging member comprising (1) a substrate, (2) a softenable layer situated on the substrate, said softenable layer comprising a softenable material and a photosensitive migration marking material, and (3) an overcoating layer situated on the surface of the softenable layer spaced from the substrate, said overcoating layer comprising a material selected from the group consisting of: (a) polyacrylic acids, (b) poly (hydroxyalkyl methacrylates), (c) poly (hydroxyalkylacrylates), (d) vinyl alcohol-vinyl acetate copolymers, (e) vinyl alcohol-vinyl butyral copolymers, (f) alkyl celluloses, (g) aryl celluloses, (h) hydroxyalkyl cellulose acrylates, (i) hydroxyaryl cellulose acrylates, (j) hydroxyalkyl cellulose methacrylates, (k) hydroxyaryl cellulose methacrylates, (l) celluloseacrylamide adducts, (m) poly(vinyl butyrals), (n) cyanoethylated celluloses, (o) cellulose acetate hydrogen phthalates, (p) hydroxypropylmethyl cellulose phthalates, (q) hydroxypropyl methyl cellulose succinates, (r) cellulose triacetates, (s) vinyl pyrrolidone-vinyl acetate copolymers, (t) vinyl chloride-vinylacetate-vinyl alcohol terpolymers, (u) ethylene-maleic anhydride copolymers, (v) styrene-maleic anhydride copolymers, (w) styrene-allyl alcohol copolymers, (x) poly (4-vinylpyridines), (y) polyester latexes, (z) vinyl chloride latexes, (aa) ethylene-vinyl chloride copolymer emulsions, (bb) poly vinyl acetate homopolymer emulsions, (cc) carboxylated vinyl acetate emulsion resins, (dd) vinyl acetate copolymer latexes, (ee) ethylene-vinyl acetate copolymer emulsions, (ff) acrylic-vinyl acetate copolymer emulsions, (gg) vinyl acrylic terpolymer latexes, (hh) acrylic emulsion latexes, (ii) polystyrene latexes, (jj) styrene-butadiene latexes, (kk) butadiene-acrylonitrile latexes, (ll) butadiene-acrylonitrilestyrene terpolymer latexes, (mm) propylene-acrylic acid copolymers, (nn) propylene-ethylene-acrylic acid terpolymers, (oo) poly(vinyl methyl ketones), (pp) poly(trimethyl hexamethylene) terephthalamides, (qq) chlorinated polypropylenes, (rr) poly(hexamethylene sebacates), (ss) poly(ethylene succinates), (tt) poly(caprolactams), (uu) poly (hexamethylene adipamides), (vv) poly(hexamethylene nonaneamides), (ww) poly(hexamethylene sebacamides), (xx) poly(hexamethylene dodecane diamides), (yy) poly (undecanoamides), (zz) poly(lauryllactams), (aaa) ethylene-methacrylic acid ionomers, and (bbb) mixtures thereof.

Copending application U.S. Ser. No. 08/432,380 now U.S. Pat. No. 5,534,374, entitled "Improved Migration Imaging Members", filed May 1, 1995 with the named inventor Shadi L. Malhotra, the disclosure of which is totally incorporated herein by reference, discloses a migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer.

Copending application U.S. Ser. No. 08/442,227 now U.S. Pat. No. 5,563,014, entitled "Improved Migration Imaging Members", filed May 15, 1995 with the named inventors Shadi L. Malhotra, Liqin Chen, and Marie-Eve Perron, the disclosure of which is totally incorporated herein by reference, discloses a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member. Also disclosed is a process which comprises (1) providing a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member; (2) uniformly charging the imaging member; (3) subsequent to step (2), exposing the charged imaging member to activating radiation at a wavelength to which the migration marking material is sensitive; (4) subsequent to step (3), causing the softenable material to soften and enabling a first portion of the migration marking material to migrate through the softenable material toward the substrate in an imagewise pattern while a second portion of the migration marking material remains substantially unmigrated within the softenable layer, wherein subsequent to migration of the first portion of migration marking material, either (a) the first portion of migration marking material contacts the transparentizing agent and the second portion of migration marking material does not contact the transparentizing agent; or (b) the second portion of migration marking material contacts the transparentizing agent and the first portion of migration marking material does not contact the transparentizing agent.

Copending application U.S. Ser. No. 08/441,360 now U.S. Pat. No. 5,514,505, entitled "Method For Obtaining Improved Image Contrast In Migration Imaging Members", filed May 15, 1995 with the named inventors William W. Limburg, Joseph Mammino, George Liebermann, Clifford H. Griffiths, Michael M. Shahin, Shadi L. Malhotra, Liqin Chen, and Marie-Eve Perron, the disclosure of which is totally incorporated herein by reference, discloses a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (3) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material.

While known apparatus and processes are suitable for their intended purposes, a need remains for improved methods for developing migration imaging members. In addition, there is a need for methods for improving the handling characteristics and robustness of developed migration imaging members. Further, there is a need for methods of developing and handling migration imaging members that reduce film preparation time, Additionally, a need remains for methods of developing migration imaging members which enables improved robustness and handling characteristics without impairing optical contrast density of the imaging members.

SUMMARY OF THE INVENTION

It is an object of the present invention to provide processes for developing and overcoating migration imaging members with the above noted advantages.

It is another object of the present invention to provide improved methods for developing migration imaging members.

It is yet another object of the present invention to provide methods for improving the handling characteristics and robustness of developed migration imaging members.

It is still another object of the present invention to provide methods of developing and handling migration imaging members that reduce film preparation time.

Another object of the present invention is to provide methods of developing migration imaging members which enables improved robustness and handling characteristics without impairing optical contrast density of the imaging members.

These and other objects of the present invention (or specific embodiments thereof) can be achieved by providing a process which comprises (1) providing a migration imaging member comprising a substrate and a softenable layer comprising a softenable material and a photosensitive migration marking material; (2) uniformly charging the imaging member; (3) subsequent to step (2), exposing the charged imaging member to activating radiation at a wavelength to which the migration marking material is sensitive; (4) subsequent to step (3), applying to the surface of the migration imaging member spaced from the substrate a substantially transparent overcoating layer and applying heat and pressure to the migration imaging member and overcoating layer, thereby causing the softenable material to soften and enabling the migration marking material to migrate through the softenable material toward the substrate in an imagewise pattern, while substantially simultaneously causing the overcoating layer to adhere to the imaging member surface.

BRIEF DESCRIPTION OF THE DRAWINGS

FIGS. 7A, 7B, 8A, 8B, 9A, 9B, 9C, 10A, 1013, 11A, 11B, 11C, 12A, and 12B illustrate schematically processes for imaging and developing migration imaging members of the present invention containing an infrared or red-light sensitive layer by imagewise exposure to infrared or red light.

DETAILED DESCRIPTION OF THE INVENTION

The processes of the present invention enable development and overcoating of migration imaging members. An example of a migration imaging member which can be prepared by the process of the present invention is illustrated schematically in FIG. 1.

Figure 1:
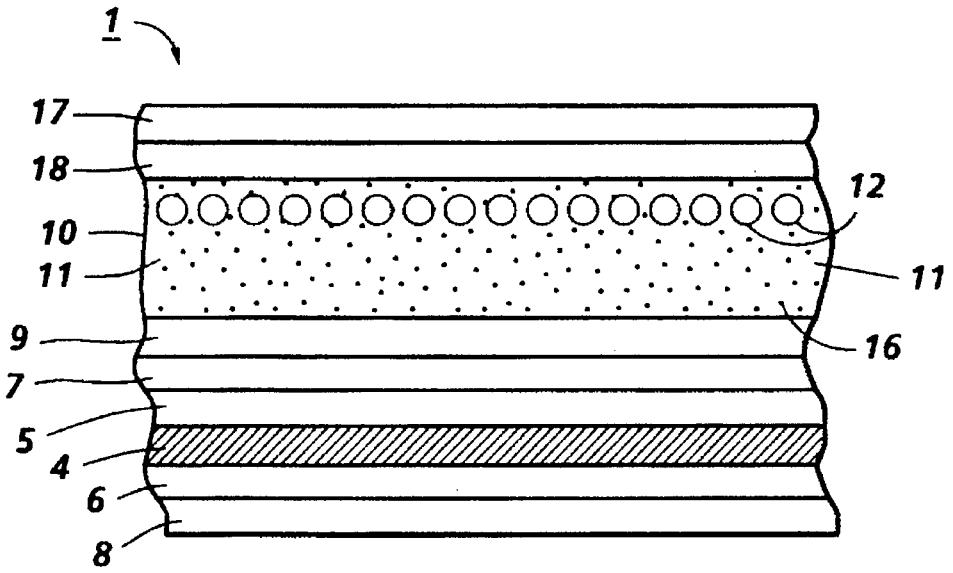
FIG. 1 illustrates schematically an imaging member which can be prepared by the apparatus and processes of the present invention.

As illustrated schematically in cross section in FIG. 1, migration imaging member 1 comprises in the order shown a substrate 4, an optional first adhesive layer 5 situated on substrate 4, an optional charge blocking layer 7 situated on optional adhesive layer 5, an optional charge transport layer 9 situated on optional charge blocking layer 7, a softenable layer 10 situated on optional charge transport layer 9, said softenable layer 10 comprising softenable material 11, optional charge transport material 16, and migration marking material 12 situated at or near the surface of the softenable layer spaced from the substrate. Overcoating layer 17 is situated on the surface of imaging member 1 spaced from the substrate 4. Optionally, second adhesion layer 18 is situated between softenable layer 10 and overcoating layer 17. Optionally, on the surface of substrate 4 spaced from that coated with softenable layer 10, second overcoating layer 8 may be coated. Optional antistatic layer 6 may be situated between optional second overcoating layer 8 and substrate 4. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styreneoacrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, and preferably from about 2 to about 25 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 25 percent by total weight of the softenable layer, and more preferably from about 10 to about 20 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

The migration marking particles can be included in the imaging member by any suitable technique. For example, a layer of migration marking particles can be placed at or just below the surface of the softenable layer by solution coating the first conductive layer with the softenable layer material, followed by heating the softenable material in a vacuum chamber to soften it, while at the same time thermally evaporating the migration marking material onto the softenable material in a vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The migration imaging members can optionally contain a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897, and 4,081,274, the disclosures of each of which are totally incorporated herein by reference. Typical diamine transport molecules include N,N'-diphenyl-N,N'-bis(3'-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)-5-(p-diethylaminophenyl) pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836. German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. Nos. 4,150,987, 4,385,106, 4,338,388, and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. Nos. 4,256,821 and 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)oxadiazole-1,3,4 described in U.S. Pat.

No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

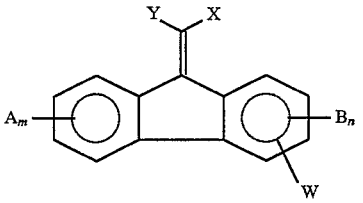

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene) malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

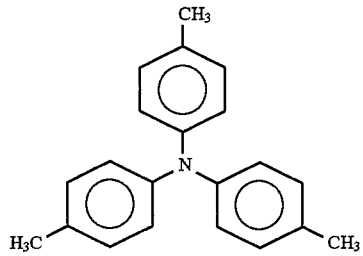

and the like, as disclosed in, for example, U.S. Pat. Nos. 3,240,597 and 3,180,730, the disclosures of which are totally incorporated herein by reference, and substituted diarylmethane and triarylmethane compounds, including bis-(4-diethylamino-2-methylphenyl)phenylmethane, of the formula

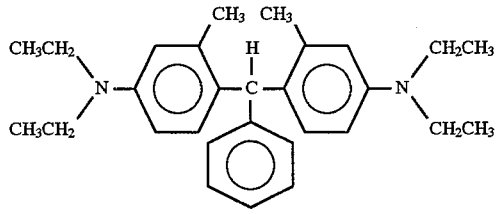

and the like, as disclosed in, for example, U.S. Pat. Nos. 4,082,551, 3,755,310, 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

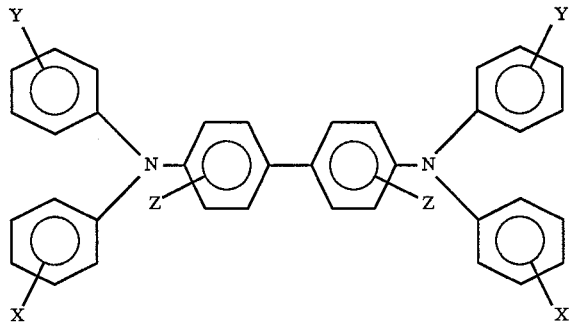

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis (chlorophenyl)-[1,1'-biphenyl]-4,4'-diamine. results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3'-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layers can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layers can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

Figure 2:
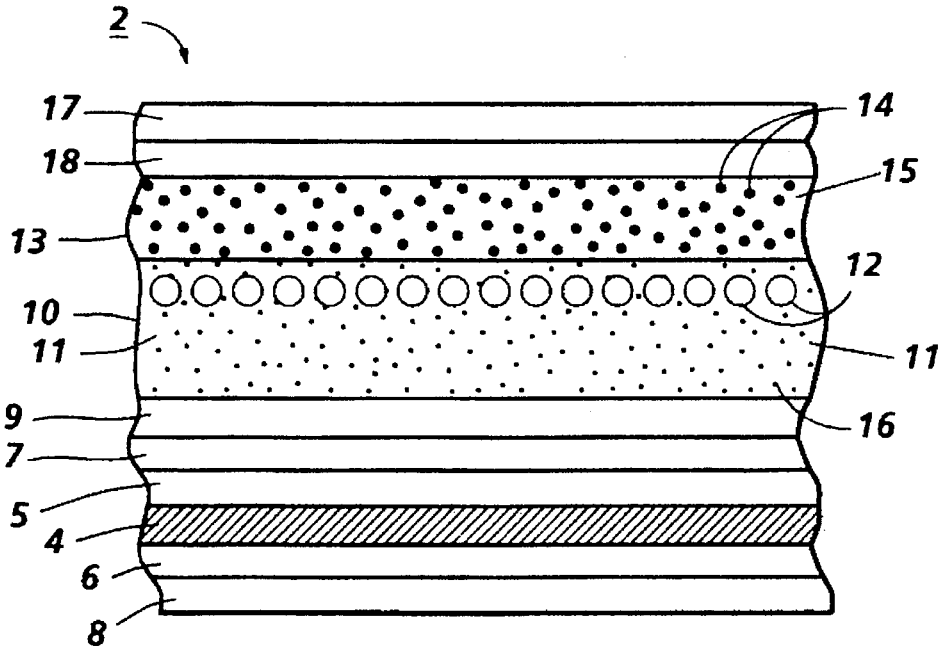
FIGS. 2 and 3 illustrate schematically infrared-sensitive imaging members which can be prepared by the apparatus and processes of the present invention.

As illustrated schematically in FIG. 2, migration imaging member 2 comprises in the order shown a substrate 4, an optional adhesive layer 5 situated on substrate 4, an optional charge blocking layer 7 situated on optional adhesive layer 5, an optional charge transport layer 9 situated on optional charge blocking layer 7, a softenable layer 10 situated on optional charge transport layer 9, said softenable layer 10 comprising softenable material 11, optional charge transport material 16, and migration marking material 12 situated at or near the surface of the softenable layer spaced from the substrate, and an infrared or red light radiation sensitive layer 13 situated on softenable layer 10 comprising infrared or red light radiation sensitive pigment particles 14 optionally dispersed in polymeric binder 15. Alternatively (not shown), infrared or red light radiation sensitive layer 13 can comprise infrared or red light radiation sensitive pigment particles 14 directly deposited as a layer by, for example, vacuum evaporation techniques or other coating methods. Overcoating layer 17 is situated on the surface of imaging member 2 spaced from the substrate 4. Optionally, second adhesion layer 18 is situated between infrared or red light sensitive layer 13 and overcoating layer 17. Optionally, on the surface of substrate 4 spaced from that coated with softenable layer 10, second overcoating layer 8 may be coated. Optional antistatic layer 6 may be situated between optional second overcoating layer 8 and substrate 4.

Figure 3:
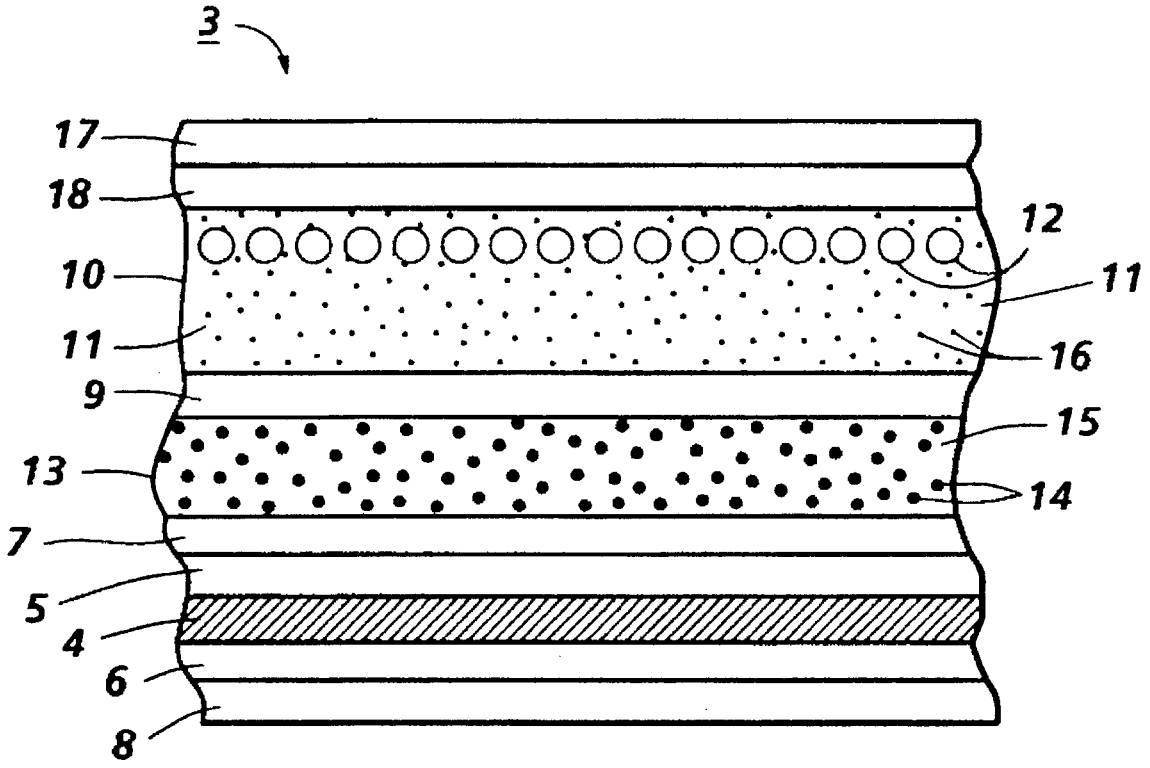

As illustrated schematically in FIG. 3, migration imaging member 3 comprises in the order shown a substrate 4, an optional adhesive layer 5 situated on substrate 4, an optional charge blocking layer 7 situated on optional adhesive layer 5, an infrared or red light radiation sensitive layer 13 situated on optional charge blocking layer 7 comprising infrared or red light radiation sensitive pigment particles 14 optionally dispersed in polymeric binder 15, an optional charge transport layer 9 situated on infrared or red light radiation sensitive layer 13, a softenable layer 10 situated on optional charge transport layer 9, said softenable layer 10 comprising softenable material 11, optional charge transport material 16, and migration marking material 12 situated at or near the surface of the softenable layer spaced from the substrate. Overcoating layer 17 is situated on the surface of imaging member 3 spaced from the substrate 4. Optionally, second adhesion layer 18 is situated between softenable layer 10 and overcoating layer 17. Optionally, on the surface of substrate 4 spaced from that coated with softenable layer 10, second overcoating layer 8 may be coated. Optional antistatic layer 6 may be situated between optional second overcoating layer 8 and substrate 4.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The optional antistatic layer 6 generally comprises a binder and an antistatic agent. The binder and antistatic agent are present in any effective relative amounts, typically from about 5 to about 50 percent by weight antistatic agent and from about 50 to about 95 percent by weight binder, and preferably about 10 percent by weight antistatic agent and about 90 percent by weight binder, although the relative amounts can be outside this range. Typical thicknesses for the antistatic layer are from about 0.5 to about 25 microns, and preferably from about 1 to about 3 microns, although the thickness can be outside these ranges. The antistatic layer can be applied to the imaging member by any desired method, such as draw bar coating, spray coating, extrusion, dip coating, gravure roll coating, wire-wound rod coating, air knife coating, and the like. In one preferred method, the antistatic layer is coated onto the imaging member by a slot extrusion process, wherein a flat die is situated with the die lips in close proximity to the web of the substrate to be coated, resulting in a continuous film of the coating solution evenly distributed across one surface of the sheet, followed by drying in an air dryer at 100° C.

Any suitable or desired binder can be employed. Examples of suitable binders include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocotl, available from Berol Kern. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as KeltroI-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such assodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly(vinyl phosphate) (such as #4391 available from Poly Sciences Inc.), (3) poly(vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573, available from Poly Sciences Inc.), and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidonediethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated ureaformaldehyde resins, available from American Cyanamid Company as Beetle 65); (d) ionic polymers, such as (1) poly(2-acrylamide2-methyl propane sulfonic acid) (such as #175 available from Scientific Polymer Products), (2) poly(N,N-dimethyl-3,5-dimethylene piperidinium chloride) (such as #401, available from Scientific Polymer Products), and (3) poly(methyleneguanidine)hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals; (4) quaternary acrylic copolymer latexes, particularly those of the formula $$\left[CH_2-\overset{\overset{R}{|}}{C}-(COOR_1)-CH_2-\overset{\overset{R}{|}}{C}-(COOR_2)\right]_n$$

n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly(acrylamide) (such as #02806, available from Poly Sciences Inc.), (2) acrylamide-acrylic acid copolymers (such as #04652, #02220, and #18545, available from Poly Sciences Inc.), and (3) poly(N, N-dimethyl acrylamide) (such as #004590, available from Poly Sciences Inc.); and (h) poly(alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly(ethylene imine), wherein alkyl has one (methoxylated), two (ethoxylated), three (propoxylated), or four (butoxylated) carbon atoms (such as ethoxylated poly(ethylene imine #636, available from Scientific Polymer Products); and the like. Any mixtures of the above ingredients in any relative amounts can also be employed.

Any desired or suitable antistatic agent can be employed. Examples of suitable antistatic agents include amine acid salts and quaternary choline halides. Examples of suitable aliphatic amine acid salts include acid salts of aliphatic primary amines, such as (I) acid salts of aliphatic diamines, of the general formula $H_2N(R_1)NH_2.H_nX^{n-}$, wherein $R_1$ can be (but is not limited to) alkyl, substituted alkyl (such as imino alkyl imine, imino alkyl imino carbonyl, dialkyl imine, or the like), alkylene, substituted alkylene (such as alkylene imine, oxyalkylene, alkylene carbonyl, mercapto alkylene, or the like), imine, diamino imine, and carbonyl, X is an anion, such as Cl, $Br^-$, $I^-$, $HSO_4^-$, $SO_4^{2-}$, $NO_3^-$, $HCOO^-$, $CH_3COO^-$, $HCO^{3-}$, $CO_3^{2-}$, $H_2PO_4^-$, $HPO_4^{2}$, $PO_4^{3-}$, $SCN^-$, $BF_4$, $ClO_4^-$, $SSO_3^-$, $CH_3SO_3^-$, $CH_3C_6H_4SO_3^-$, or the like, as well as mixtures thereof, and n is an integer of 1, 2, or 3, including (a) guanidine compounds, such as (1) guanidine hydrochloride [$H_2NC(=NH)NH_2.HCl$] (Aldrich 17,725-3, G1,170-5); (2) guanidine sulfate [$H_2NC(=NH)NH_2]_2.H_2SO_4$ (Aldrich 30,739-4); (3) guanidine nitrate [$H_2NC(=NH)NH_2.HNO_3$] (Aldrich 23,424-9); (4) guanidine carbonate [$H_2NC(=NH)NH_2]_2.H_2CO_3$ (Aldrich G1,165-9); (5) guanidine thiocyanate [$H_2NC(=NH)NH_2.HSCN$] (Aldrich 29,288-5); (6) amino guanidine bicarbonate [$H_2NNHC(=NH)NH_2.H_2CO_3$] (Aldrich 10,926-6); (7) amino guanidine nitrate [$H_2NNHC(=NH)NH_2.HNO_3$] (Aldrich A5,610-8); (8) amino guanidine hemisulfate [$NH_2NHC(=NH)NH_2].H_2SO_4$ (Kodak 4023, available from Eastman Kodak Co.); (9) 1,3-diamino guanidine monohydrochloride [$H_2NNHC(=NH)NHNH_2.HCl$] (Aldrich 14,341-3); (10) N-guanyl urea sulfate hydrate [$H_2NC(=NH)NHCONH_2]_2.H_2SO_4.xH_2O$ (Aldrich 27,345-7); (11) (4-amino butyl) guanidine sulfate $H_2N(CH_2)_4NHC(=NH)NH_2.H_2SO_4$ (Aldrich 10,144-3); (12) malonamamidine hydrochloride $H_2NC(=NH)CH_2CONH_2.HCl$ (Aldrich 17,651-6); and the like; (b) alkylene compounds, such as (1) ethylene diamine dihydrochloride $H_2N(CH_2)_2NH_2.2HCl$ (Aldrich 19,580-4); (2) 1,3-diaminopropane dihydrochloride $H_2N(CH_2)_3NH_2.2HCl$ (Aldrich D2,380-7); (3) 1,4-diamino butane dihydrochloride $H_2N(CH_2)_4NH_2.2HCl$ (Aldrich 23,400-1); (4) 1,5-diamino pentane dihydrochloride $H_2N(CH_2)_5NH_2.2HCl$ (Aldrich 27,182-9); (5) 1,6-diamine hexane dihydrochloride $H_2N(CH_2)_6NH_2.2HCl$ (Aldrich 24,713-1); (6) triethylene tetramine dihydrochloride $H_2N(CH_2)_2NH(CH_2)_2NH(CH_2)_2NH_2.2HCl$ (Aldrich 29,951-0); (7) triethylene tetramine tetrahydrochloride $H_2N(CH_2)_2NH(CH_2)_2NH(CH_2)_2NH_2.4HCl$ (Aldrich 16,196-9); (8) spermine tetrahydrochloride $H_2N(CH_2)_3NH(CH_2)_4NH_2.4HCl$ (Aldrich 28,716-4); (9) spermidine trihydrochloride $H_2N(CH_2)_4NH(CH_2)_3NH_2.3HCl$ (Aldrich 23,399-4); (10) cystamine dihydrochloride $S_2(CH_2CH_2NH_2)_2.2HCl$ (Aldrich C12,150-9); (11) 2,2'-oxybis(ethylamine)dihydrochloride $O(CH_2CH_2NH_2)_2.2HCl$ (Aldrich 17,609-5); (12) glycinamide hydrochloride $H_2NCH_2CONH_2.HCl$ (Aldrich G610-4); (13) 1,3-diamino acetone dihydrochloride monohydrate $H_2NCH_2COCH_2NH_2.2HCl.H_2O$ (Aldrich 23,244-0); (14) urea sulfate $(H_2NCONH_2)_2.H_2SO_4$ (Aldrich 28,059-3); (15) urea phosphate $H_2NCONH_2.H_3PO_4$ (Aldrich 29,282-6); (16) 2,2-dimethyl-1,3-propane diamine dihydrochloride $H_2NCH_2C(CH_3)_2CH_2NH_2.2HCl$ (Aldrich 22,693-9); (17) 1,4-diamino-2-butanone dihydrochloride $H_2NCH_2CH_2COCH_2CH_2NH_2.2HCl$ (Aldrich 19, 933-8); (18) L-leucinamide hydrochloride $(CH_3)_2CHCH_2CH(NH_2)CONH_2.HCl$ (Aldrich 28,642-7); (19) (2-aminoethyl) trimethyl ammonium chloride hydrochloride $H_2NCH_2CH_2N(CH_3)_3Cl.HCl$ (Aldrich 28,455-6); and the like; (II) acid salts of aliphatic monoamines, of the general formula $R_2NH_2.H_nX^{n-}$, wherein $R_2$ can be (but is not limited to) alkyl, substituted alkyl (such as alkyl imine, alkoxy alkyl imine, alkyl amino imine, halogenated alkyl imine, alky mercaptylimine, alkylamine alkoxy amine, alkyl mercapto amine, halogenated alkyl amine, halogenated alkyl amide, alkyl ester, allyl alkyl amine, alkyl mercaptyl ester, and the like), alkylene, substituted alkylene (such as alkylene imine, alkylene ester, and the like), imine, amine, substituted amine (such as hydroxylamine, alkyne hydroxyl amino, halogenated amine, and the like), anhydride ester, and the like, X is an anion, such as $Cl^-$, $Br^-$, $I^-$, $HSO_{4-}$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3$, $CH_3C_6H_4SO_3^-$, or the like, as well as mixtures thereof, and n is an integer of 1, 2, or 3, including (a) guanidine compounds, such as (1) formamidine hydrochloride $HC(=NH)NH_2.HCl$ (Aldrich 26,860-7); (2) formamidine disulfide dihydrochloride [$—SC(=NH)NH_2]_2.2HCl$ (Aldrich 21,946-0); (3) formamidine acetate $HC(=NH)NH_2.CH_3COOH$ (Aldrich F1,580-3); (4) acetamidine hydrochloride $CH_3C(=NH)NH_2.HCl$ (Aldrich 15,915-8); (5) acetamidine acetate $H_3CC(=NH)NH_2.CH_3COOH$ (Aldrich 26,997-2); (6) 2-ethyl-2-thiopseudo urea hydrobromide $C_2H_5SC(=NH)NH_2.HBr$ (Aldrich 30,131-0); (7) guanidine acetic acid [$H_2NC(=NH)NHCH_2COOH$] (Aldrich G1,160-8); (8) 1,1-dimethyl biguanide hydrochloride [$(CH_3)_2NC(=NH)NHC(=NH)NH_2.HCl$](Aldrich D15,095-9); (9) 1-methyl guanidine hydrochloride $CH_3NHC(=NH)NH_2.HCl$ (Aldrich 22,240-2); (10) methyl guanidine sulfate [$CH_3NHC(=NH)NH_2]_2.H_2SO_4$ (Kodak 1482, available from Eastman Kodak Co.); (11) 1-ethyl guanidine hydrochloride $C_2H_5NHC(=NH)NH_2.HCl$ (Aldrich 29,489-6); (12) 1-ethyl guanidine sulfate [$C_2H_5NHC(=NH)NH_2]_2.H_2SO_4$ (Aldrich 27,555-7); (13) dodecyl guanidine hydrochloride [$CH_3(CH_2)_{11}HNC(=NH)NH_2.HCl$] (Betz Paper Company Slimerrol RX=31, 32); (14) 1-(2,2-diethoxyethyl)

guanidine sulfate $[(C_2H_5O)_2CHCH_2NHC(=NH)NH_2]_2.H_2SO_4$ (Aldrich 19,790-4); (15) methyl glyoxal bis(guanyl hydrazone)dihydrochloride hydrate $CH_3C[=NNHC(=NH)NH_2]CH[=NNHC(=NH)NH_2].2HCl.xH_2O$ (Aldrich 13,949-1); (16) 2-ethyl-2-thiopseudourea hydrobromide $C_2H_5SC(=NH)NH_2.HBr$ (Aldrich 30,131-0); (17) 2-methyl-2-thiopseudourea sulfate $[CH_3SC(=NH)NH_2]_2.H_2SO_4$ (Aldrich M8,444-5); (18) o-methyl isourea hydrogen sulfate $CH_3OC(=NH)NH_2.H_2SO_4$ (Aldrich M5,370-1); (19) S,S'-(1,3-propanediyl)bis(isothiouronium bromide) $CH_2[CH_2SC(=NH)NH_2]_2.2HBr$ (Aldrich 24,318-3); and the like; (b) alkyl amines, such as (1) methyl amine hydrochloride $CH_3NH_2.HCl$ (Aldrich 12,970-4); (2) ethyl amine hydrochloride $C_2H_5NH_2.HCl$ (Aldrich 23,283-1); (3) 3-chloropropylamine hydrochloride $Cl(CH_2)_3NH_2.HCl$ (Aldrich 14,254-9); (4) aminomethyl cyclopropane hydrochloride $C_3H_5CH_2NH_2.HCl$ (Aldrich A6,380-5); (5) 2-methyl allyl amine hydrochloride $H_2C=C(CH_3)CH_2NH_2.HCl$ (Aldrich 27,906-4); (6) amino acetonitrile hydrochloride $H_2N(CH_2CN).HCl$ (Aldrich 13,052-4); (7) amino acetonitrile bisulfate $H_2N(CH_2CN).H_2SO_4$ (Aldrich 27,999-4); (8) tert-butyl hydrazine hydrochloride $(CH_3)_3CNHNH_2.HCl$ (Aldrich 19,497-2); (9) methoxyl amine hydrochloride $CH_3ONH_2.HCl$ (Aldrich 22,551-7); (10) ethanol amine hydrochloride $H_2NCH_2CH_2OH.HCl$ (Aldrich 23,638-1); (11) O-(tert butyl)hydroxylamine hydrochloride $(CH_3)_3CONH_2.HCl$ (Aldrich 34,006-5); (12) 6-amino-2-methyl-2-heptanol hydrochloride $CH_3CH(NH_2)(CH_2)_3C(CH_3)_2OH.HCl$ (Aldrich 29,620-1); (13) o-allyl hydroxyl amine hydrochloride hydrate $H_2C=CHCH_2ONH_2.HCl.xH_2O$ (Aldrich 25,456-8); (14) hydroxylamine hydrochloride $H_2NOH.HCl$ (Aldrich 25,558-0; 15,941-7); (15) hydroxylamine phosphate $(H_2NOH)_3.H_3PO_4$ (Aldrich 34,235-1); (16) hydroxylamine sulfate $(H_2NOH)_2.H_2SO_4$ (Aldrich 21,025-1); (17) D,L-serinol hydrochloride $H_2NCH(CH_2OH)_2.HCl$ (Aldrich 28,715-6); (18) 2-(ethylthio)ethylamine hydrochloride $C_2H_5SCH_2CH_2NH_2.HCl$ (Aldrich 12,042-1); (19) o-ethyl hydroxylamine hydrochloride $C_2H_5ONH_2.HCl$ (Aldrich 27,499-2); (20) tris(hydroxymethyl)aminomethane hydrochloride $(HOCH_2)_3CNH_2.HCl$ (Aldrich 85,764-5); (21) octadecylamine hydrochloride $CH_2(CH_2)_{17}NH_2.HCl$ (Kodak 9209, available from Eastman Kodak Co.); (22) 2-aminoethyl hydrogen sulfate $NH_2CH_2CH_2OSO_3H$ (Kodak P5895, available from Eastman Kodak Co.); (23) 2-aminoethane thiosulfuric acid $NH_2CH_2CH_2SSO_3H$ (Kodak 8413, available from Eastman Kodak Co.); (24) 2-bromoethylamine hydrobromide $BrCH_2CH_2NH_2.HBr$ (Kodak 5020, available from Eastman Kodak Co.); and the like; (c) ester compounds, such as (1) glycine methylester hydrochloride $H_2NCH_2COOCH_3.HCl$ (Aldrich G-660-0); (2) L-methionine methyl ester hydrochloride $CH_3SCH_2CH_2CH(NH_2)COOCH_3.HCl$ (Aldrich 86,040-9); (3) L-alanine methyl ester hydrochloride $CH_3CH(NH_2)COOCH_3.HCl$ (Aldrich 33,063-9); (4) L-leucine methyl ester hydrochloride $(CH_3)_2CHCH_2CH(NH_2)COOCH_3.HCl$ (Aldrich L100-2); (5) glycine ethyl ester hydrochloride $H_2NCH_2COOC_2H_5.HCl$ (Aldrich G650-3); (6) β-alanine ethyl ester hydrochloride $H_2N(CH_2)_2COOC_2H_5.HCl$ (Aldrich 30,614-2); (7) ethyl 4-aminobutyrate hydrochloride $H_2N(CH_2)_3COOC_2H_5.HCl$ (Aldrich E1,060-2); (8) alanine ethyl ester hydrochloride $CH_3CH(NH_2)COOC_2H_5.HCl$ (Aldrich 26,886-0; 85,566-9); (9) L-methionine ethyl ester hydrochloride $CH_3SCH_2CH_2CH(NH_2)COOC_2H_5.HCl$ (Aldrich 22,067-1); (10) glycine tert butyl ester hydrochloride $H_2NCH_2COOC(CH_3)_3.HCl$ (Aldrich 34,795-7); (11) L-valine ethyl ester hydrochloride $(CH_3)_2CHCH(NH_2)COOC_2H_5.HCl$ (Aldrich 22,069-8); (12) L-valine methylester hydrochloride $(CH_3)_2CHCH(NH_2)COOCH_3.HCl$ (Aldrich 86,027-1); (13) N-a-acetyl-L-lysine methylester hydrochloride $H_2N(CH_2)_4CH(NHCOCH_3)COOCH_3.HCl$ (Aldrich 85,909-5); (14) methyl 5-aminolevulinate hydrochloride $H_2NCH_2COCH_2COOCH_3.HCl$ (Aldrich 28,506-4); and the like.

Also suitable are acid salts of aliphatic secondary amines, such as (III) those of the general formula $R_3R_4NH.H_nX^{n-}$, wherein $R_3$ and $R_4$ each, independently of one another, can be (but are not limited to) alkyl (includingcyclic alkyl), substituted alkyl (such as hydroxyalkyl, alkoxy alkyl, alkyl nitride, alkylene alkyl, or the like), alkylene, substituted alkylene (such as alkoxy alkylene or the like), hydroxyl, nitrile, oxyalkyl, oxyalkylene, and the like, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) dimethylamine hydrochloride $(CH_3)_2NH.HCl$ (Aldrich 12,636-5); (2) diethyl amine hydrochloride $(C_2H_5)_2NH.HCl$ (Aldrich 12,774-4); (3) diethyl amine hydrobromide $(C_2H_5)_2NH.HBr$ (Aldrich 31,090-5); (4) diethyl amine phosphate $(C_2H_5)_2NH.H_3PO_4$ (Aldrich 14,115-1); (5) N-propylcyclopropane methyl amine hydrochloride $C_3H_5CH_2NHCH_2CH_2CH_3.HCl$ (Aldrich 22,758-7); (6) isopropyl formimidate hydrochloride $HC(=NH)OCH(CH_3)_2.HCl$ (Aldrich 34,624-1); (7) N-isopropyl hydroxylamine hydrochloride $(CH_3)_2CHNHOH.HCl$ (Aldrich 24,865-7); (8) N-(tert butyl) hydroxylamine hydrochloride $(CH_3)_3CNHOH.HCl$ (Aldrich 19,475-1); (9) dimethyl suberimidate dihydrochloride $CH_3OC(=NH)(CH_2)_6C(=NH)OCH_3.2HCl$ (Aldrich 17,952-3); (10) N-methylhydroxylamine hydrochloride $CH_3NHOH.HCl$ (Aldrich M5,040); (11) methyl amino acetonitrile hydrochloride $CH_3NHCH_2CN.HCl$ (Aldrich M2,810-3); (12) N-cyclohexyl hydroxylamine hydrochloride $C_6H_{11}NHOH.HCl$ (Aldrich 18,646-5); (13) dimethyl adipimidate dihydrochloride $CH_3OC(=NH)(CH_2)_4C(=NH)OCH_3.2HCl$ (Aldrich 28,562-5); and the like.

Also suitable are acid salts of aliphatic tertiary amines, such as (IV) those of the general formula $R_5R_6R_7(N).H_nX^{n-}$, wherein $R_5$, $R_6$, and $R_7$ each, independently of one another, can be (but are not limited to) alkyl, substituted alkyl (such as hydroxyalkyl, alkyl halide, alkyl carbonyl, and the like), alkylene, substituted alkylene (such as hydroxy alkylene and the like), alkoxy, thiol, carboxyl, and the like, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) trimethylamine hydrochloride $(CH_3)_3N.HCl$ (Aldrich T7,276-1); (2) triethylamine hydrochloride $(C_2H_5)_3N.HCl$ (Aldrich 26,815-1); (3) triethanol amine hydrochloride $(HOCH_2CH_2)_3N.HCl$ (Aldrich 15,891-7); (4) 2-dimethyl amino isopropyl chloride hydrochloride $CH_3CH(Cl)CH_2N(CH_3)_2.HCl$ (AldrichD14,240-9); (5) 2-dimethyl amino ethyl chloride hydrochloride $(CH_3)_2NCH_2CH_2Cl.HCl$ (Aldrich D14,120-8); (6) 3-dimethyl amino-2-methyl propyl chloride hydrochloride $(CH_3)_2NCH_2CH(CH_3)CH_2Cl.HCl$ (Aldrich 15,289-7); (7) 2-dimethyl aminoethanethiol hydrochloride $(CH_3)_2NCH_2CH_2SH.HCl$ (Aldrich D14,100-3); (8) N,N-dimethyl glycine hydrochloride $(CH_3)_2NCH_2COOH.HCl$ (Aldrich 21,960-6); (9) 4-(dimethyl amino)butyric acid hydrochloride $(CH_3)_2N(CH_2)_3COOH.HCl$ (Aldrich 26,373-7); (10) N,N-dimethyl hydroxylamine hydrochloride $HON(CH_3)_2$.

HCl (Aldrich 2,145-7); (11) N,O-dimethyl hydroxylamine hydrochloride $CH_3ONHCH_3.HCl$ (Aldrich D16,3780-8); (12) 3-[bis(2-hydroxyethyl)amino]2-hydroxy-1-propane sulfonic acid $(HOCH_2CH_2)_2NCH_2CH(OH)CH_2SO_3H$ (Aldrich 34,004-9); (13) 2,3-bis(hydroxyamino)-2,3-dimethyl butane sulfate $(CH_3)_2C(NHOH)C(NHOH)(CH_3)_2.H_2SO_4$ (Kodak 11659, available from Eastman Kodak Co.); (14) N,N-bis(2-hydroxyethyl)-2-amino ethane sulfonic acid $(HOCH_2CH_2)_2NCH_2CH_2SO_3H$ (Kodak 14999, available from Eastman Kodak Co.); and the like.

Also suitable are (V) acid salts of cyclic aliphatic amines, such as (1) (±)-α-amino-β-butyrolactone hydrobromide (Aldrich A4, 450-9), of the formula

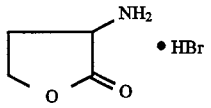

(2) D,L-homocysteine thiolactone hydrochloride (Aldrich H1,580-2), of the formula

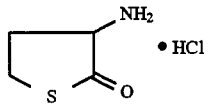

(3) (±)-endo-2-aminonorbornane hydrochloride (Aldrich 13, 351-5), of the formula

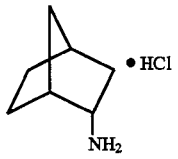

(4) N-ethyl-3-phenyl-2-norbornanamine hydrochloride (Aldrich 17, 951-5), of the formula

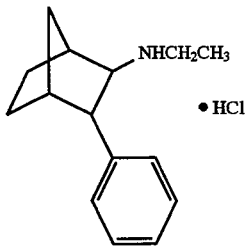

(5) 1-adamantanamine hydrochloride (Aldrich 11,519-3), of the formula

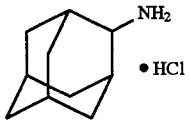

(6) 1,3-adamantane diamine dihydrochloride (Aldrich 34, 081-2), of the formula

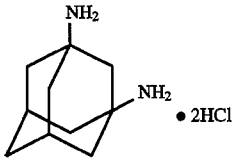

(7) 3-noradamantanamine hydrochloride (Aldrich 29, 187-0), of the formula

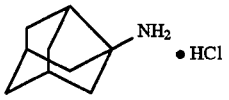

(8) 9-aminofluorene hydrochloride (Aldrich A5, 560-8), of the formula

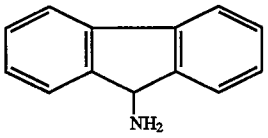

and the like.

Also suitable are acid salts of aromatic amines, such as (VI) acid salts of aromatic amines having both —$NH_2$and —OH groups, such as (1) (±)-octopamine hydrochloride $HOC_6H_4CH(CH_2NH_2)OH.HCl$ (Aldrich 13,051-6); (2) (±)-norphenylephrine hydrochloride $HOC_6H_4CH(CH_2NH_2)OH.HCl$ (Aldrich 11,372-7); (3) norephedrine hydrochloride $C_6H_5CH(OH)CH(CH_3)NH_2.HCl$ (Aldrich 13,143-1, 19,362-3); (4) norepinephrine hydrochloride $(HO)_2C_6H_3CH(CH_2NH_2)OH.HCl$ (Aldrich 17,107-7); (5) (1R,2R)-(−)-norpseudoephedrine hydrochloride $C_6H_5CH(OH)CH(CH_3)NH_2.HCl$ (Aldrich 19,363-1); (6) (±)-α-(1-aminoethyl)-4-hydroxybenzyl alcohol hydrochloride $HOC_6H_4CH[CH(NH_2)CH_3]OH.HCl$ (Aldrich A5,445-8); (7) 2[2-(aminomethyl)phenylthio]benzylalcohol hydrochloride $H_2NCH_2C_6H_4SC_6H_4CH_2OH.HCl$ (Aldrich 34,632-2); (8) 1-amino-2-naphthol hydrochloride $H_2NC_{10}H_6OH.HCl$ (Aldrich 13,347-7); (9) 4-amino-1-naphthol hydrochloride $H_2NC_{10}H_6OH.HCl$ (Aldrich 13,348-5); (10) tyramine hydrochloride $HOC_6H_4CH_2CH_2NH_2.HCl$ (Aldrich T9,035-2); (11) L-tyrosine hydrochloride $HOC_6H_4CH_2CH(NH_2)COOH.HCl$ (Aldrich 28,736-9); (12) O-methyldopamine hydrochloride $CH_3OC_6H_3(OH)CH_2CH_2NH_2.HCl$ (Aldrich 19,596-0, Aldrich 16,431-3); (13) hydroxy dopamine hydrochloride $(HO)_3C_6H_2CH_2CH_2NH_2.HCl$ (Aldrich 15,156-4, 14,980-2); (14) hydroxy dopamine hydrobromide $(HO)_3C_6H_2CH_2CH_2NH_2.HBr$ (Aldrich 16,295-7); (15) 3-hydroxytyramine hydrochloride $(HO)_2C_6H_3CH_2CH_2NH_2.HCl$ (Aldrich H6,025-5); (16) 3-hydroxytyramine hydrobromide $(HO)_2C_6H_3CH_2CH_2NH_2.HBr$ (Aldrich 16,113-6); (17) o-benzyl hydroxyl amine hydrochloride $C_6H_5CH_2ONH_2.HCl$ (Aldrich B2,298-4); (18) aminomethyl-1-cyclohexanol hydrochloride $H_2NCH_2C_6H_{10}OH.HCl$ (Aldrich 19,141-8); (19) 2-amino cyclohexanol hydrochloride $H_2NC_6H_{10}OH.HCl$ (Aldrich 26,376-1); (20) 4-amino-2,3-dimethyl phenol hydrochloride $H_2NC_6H_2(CH_3)_2OH.HCl$ (Aldrich 24,416-3); (21) 4-(2-hydroxyethylthio)1-3-phenylenediamine dihydrochloride $HO(CH_2CH_2S)C_6H_3(NH_2)_2.2HCl$ (Aldrich 20,923-6); (22) 2-amino-3-hydroxy benzoic acid hydrochloride $HOC_6H_3NH_2COOH.HCl$ (Aldrich 30,690-8); (23) 4-hydroxy-3-methoxy benzyl amine hydrochloride $HOC_6H_3(OCH_3)CH_2NH_2.HCl$ (Aldrich H3,660-5); (24) 4-amino phenol hydrochloride $H_2NC_6H_4OH.HCl$ (Aldrich 27,406-2); (25) 2-[2-(aminomethyl)phenyl thio]benzyl alcohol hydrochloride $H_2NCH_2C_6H_4SC_6H_4CH_2OH.HCl$ (Aldrich 34,632-2); (26) amino diphenyl methane hydrochloride $(C_6H_5)_2CHNH_2.HCl$ (Aldrich 17,688-5); (27) (4-aminophenyl) trimethyl ammonium iodide hydrochloride $(CH_3)_3N(I)C_6H_4NH_2.HCl$ (Kodak 11372, available from Eastman Kodak Co.); (28) 4-aminoantipyrine hydrochloride (Kodak 6535, available from Eastman Kodak Co.), of the formula

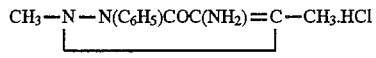

and the like.

Also suitable are (VII) acid salts of aromatic amines having a hydrazine (—$NRNH_2$) group, wherein R is hydrogen, alkyl, or aryl, such as (1) tolylhydrazine hydrochloride $CH_3C_6H_4NHNH_2.HCl$ (Aldrich 28,190-5, T4,040-1, T4,060-6); (2) 3-chloro-p-tolyl hydrazine hydrochloride $ClC_6H_3(CH_3)NHNH_2.HCl$ (Aldrich 15,343-5); (3) 4-chloro-o-tolylhydrazine hydrochloride $ClC_6H_3(CH_3)NHNH_2.HCl$ (Aldrich 15,283-8); (4) chlorophenyl hydrazine hydrochloride $ClC_6H_4NHNH_2.HCl$ (Aldrich 10,950-9; 15,396-6; C6,580-7); (5) 3-nitrophenyl hydrazine hydrochloride $O_2NC_6H_4NHNH_2.HCl$ (Aldrich N2,180-4); (6) 4-isopropyl phenylhydrazine hydrochloride $(CH_3)_2CHC_6H_4NHNH_2.HCl$ (Aldrich 32,431-0); (7)dimethyl phenyl hydrazine hydrochloride hydrate $(CH_3)_2C_6H_3NHNH_2.HCl.xH_2O$ (Aldrich 32,427-2, 32,428-0; 32,429-9); (8) 1,1-diphenyl hydrazine hydrochloride $(C_6H_5)_2NNH_2.HCl$ (Aldrich 11,459-6); (9) 3-hydroxybenzyl hydrazine dihydrochloride $HOC_6H_4CH_2NHNH_2.2HCl$ (Aldrich 85,992-3); and the like.

Also suitable are (VIII) acid salts of aromatic diamine and substituted diamine containing compounds, such as (1) phenylene diamine dihydrochloride $C_6H_4(NH_2)_2.2HCl$ (Aldrich 23,590-3, 13,769-3); (2) N,N-dimethyl-1,3-phenylene diamine dihydrochloride $(CH_3)_2NC_6H_4NH_2.2HCl$ (Aldrich 21,922-3); (3) N,N-dimethyl-1,4-phenyiene diamine monohydrochloride $(CH_3)_2NC_6H_4NH_2.HCl$ (Aldrich 27,157-8); (4) N,N-dimethyl-1,4-phenylene diamine dihydrochloride $(CH_3)_2NC_6H_4NH_2.2HCl$ (Aldrich 21,923-1); (5) N,N-dimethyl-1,4-phenylene diamine sulfate $(CH_3)_2NC_6H_4NH_2.H_2SO_4$ (Aldrich 18,638-4); (6) 4,4'-diamino diphenylamine sulfate $(H_2NC_6H_4)_2NH.H_2SO_4$ (Aldrich D1,620-7); (7) N,N-diethyl-1,4-phenylene diamine sulfate $(C_2H_5)_2NC_6H_4NH_2.H_2SO_4$ (Aldrich 16,834-3); (8) 2,4-diamino phenol dihydrochloride $(H_2N)_2C_6H_3OH.2HCl$ (Aldrich 23,010-3); (9) 4-(dimethyl amino)benzyl amine dihydrochloride $(CH_3)_2NC_6H_4CH_2NH_2.2HCl$ (Aldrich 28,563-3); (10) 3,3'-dimethoxy benzidine hydrochloride hydrate $[—C_6H_3(OCH_3)NH_2]_2.xHCl.xH_2O$ (Aldrich 19,124-8); (11) 4,4'-diaminostilbene dihydrochloride $H_2NC_6H_4CH{=}CHC_6H_4NH_2.2HCl$ (Aldrich D2,520-6); (12) 4-(aminomethyl)benzene sulfonamide hydrochloride hydrate $H_2NCH_2C_6H_4SO_2NH_2.HCl.xH_2O$ (Aldrich A6,180-2); (13) 4-methoxy-1,2-phenylene diamine dihydrochloride $CH_3OC_6H_3(NH_2)_2.2HCl$ (Aldrich M2,040-4); (14) procaine hydrochloride $H_2NC_6H_4COOCH_2CH_2N(C_2H_5)_2.HCl$ (Aldrich 22,297-6); (15) procain amide hydrochloride $H_2NC_6H_4CONHCH_2CH_2N(C_2H_5)_2.HCl$ (Aldrich 22,296-8); (16) 3,3',5,5'-tetramethyl benzidine dihydrochloride hydrate $[C_6H_2(CH_3)_2\text{-}4\text{-}NH_2]_2.2HCl.xH_2O$ (Aldrich 86,151-0); (17) N-(1-naphthyl)ethylene diamine dihydrochloride $C_{10}H_7NHCH_2CH_2NH_2.2HCl$ (Aldrich 22,248-8); (18) D,L-alanine-2-naphthylamide hydrochloride $CH_3CH(NH_2)CONHC_{10}H_7.HCl$ (Aldrich 85,677-0); (19) N-(4-methoxyphenyl)-1,4-phenylene diamine hydrochloride $CH_3OC_6H_4NHC_6H_4NH_2.HCl$ (Aldrich 21,702-6); (20) 2-methoxy-1,4-phenylene diamine sulfate hydrate $CH_3OC_6H_3(NH_2)_2.H_2SO_4.xH_2O$ (Aldrich 17,006-2); (21) 2,2-dimethyl,-1,3-propane diamine dihydrochloride $H_2NCH_2C(CH_3)_2CH_2NH_2.2HCl$ (Aldrich 22,693-9); and the like.

Also suitable are (IX) acid salts of aromatic guanidine compounds, of the general formula $R_8—C(=NH)NH_2.H_nX^{n-}$, wherein $R_8$ can be (but is not limited to) aryl (such as phenyl or the like), substituted aryl (such as amino phenyl, amido phenyl, or the like), arylalkyl (such as benzyl and the like), substituted arylalkyl (such as amino alkyl phenyl, mercaptyl benzyl, and the like) and the like, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) benzamidine hydrochloride $C_6H_5C(=NH)NH_2.HCl$ (Kodak 6228, available from Eastman Kodak Co.) and benzamidine hydrochloride hydrate $C_6H_5C(=NH)NH_2.HCl.xH_2O$ (Aldich B 200-4); (2) 4-amidino benzamide hydrochloride $H_2NC(=NH)C_6H_4CONH_2.HCl$ (Aldrich 24,781-2); (3) 3-aminobenzamidine dihydrochloride $H_2NC_6H_4C(=NH)NH_2.2HCl$ (Aldrich 85,773-4); (4) 4-aminobenzamidine dihydrochloride $H_2NC_6H_4C(=NH)NH_2.2HCl$ (Aldrich 85,766-1); (5) 1-(3-phenyl propyl amino)guanidine hydrochloride $C_6H_5(CH_2)_3NHNHC(=NH)NH_2.HCl$ (Aldrich 22,161-9); (6) 2-benzyl-2-thiopseudourea hydrochloride $C_6H_5CH_2SC(=NH)NH_2.HCl$ (Aldrich 25,103-8); and the like.

Also suitable are (X) acid salts of aromatic monoamines, such as those of the general formula $R_9—NH_2.H_nX^{n-}$, wherein $R_9$ can be (but is not limited to) aryl (such as phenyl or the like), substituted aryl (such as phenyl alkyl, phenyl cyclic alkyl, phenyl alkyl carbonyl halide, phenyl alkyl carbonyl halide, or the like), arylalkyl, substituted arylalkyl (such as alkoxy phenyl alkyl, aryloxy phenyl alkyl, aryloxy alkyl, or the like), or the like, and X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4$-, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) 2-phenyl cyclopropyl amine hydrochloride $C_6H_5C_3H_4NH_2.HCl$ (Aldrich P2,237-0); (2) amino diphenyl methane hydrochloride $(C_6H_5)_2CHNH_2.HCl$ (Aldrich 17,688-5); (3) (R)-(−)-2-phenyl glycine chloride hydrochloride $C_6H_5CH(NH_2)COCl.HCl$ (Aldrich 34,427-3); (4) phenethylamine hydrochloride $C_6H_5(CH_2)_2NH_2.HCl$ (Aldrich 25,041-4); (5) 2,4-dimethoxybenzylamine hydrochloride $(CH_3O)_2C_6H_3CH_2NH_2.HCl$ (Aldrich 17,860-8); (6) 3,4-dibenzyloxy phenethyl amine hydrochloride $(C_6H_5CH_2O)_2C_6H_3CH_2CH_2NH_2.HCl$ (Aldrich 16,189-6); (7) 2,2-diphenyl propylamine hydrochloride $CH_3C(C_6H_5)_2CHNH_2.HCl$ (Aldrich 18,768-2); (8) 2,4,6-trimethoxy benzylamine hydrochloride $(CH_3O)_3C_6H_2CH_2NH_2.HCl$ (Aldrich 30,098-5); (9) 4-benzyloxyaniline hydrochloride $C_6H_5CH_2OC_6H_4NH_2.HCl$ (Aldrich 11,663-7); (10) benzylamine hydrochloride $C_6H_5CH_2NH_2.HCl$ (Aldrich 21,425-6); and the like.

Also suitable are (XI) acid salts of aromatic amino esters, such as (1) N-α-p-tosyl-L-arginine methylester hydrochloride $H_2NC(=NH)NH(CH_2)_3CH(NHSO_2C_6H_4CH_3)COOCH_3.HCl$ (Aldrich T4,350-8); (2) L-phenyl alanine methyl ester hydrochloride $C_6H_5CH_2CH(NH_2)$ $COOCH_3.HCl$ (Aldrich P1,720-2); (3) D,L-4-chlorophenylalanine methyl ester hydrochloride $ClC_6H_4CH_2CH(NH_2)COOCH_3.HCl$ (Aldrich 27,181-0); (4) ethyl 4-aminobenzoate hydrochloride $H_2NC_6H_4COOC_2H_5.HCl$ (Aldrich 29,366-0); (5) L-phenyl alanine ethyl ester hydrochloride $C_6H_5CH_2CH(NH_2)COOC_2H_5.HCl$ (Aldrich 22,070-1); (6) D,L-4-chlorophenylalanine ethyl ester hydrochloride $ClC_6H_4CH_2CH(NH_2)COOC_2H_5.HCl$ (Aldrich 15,678-7); and the like.

Also suitable are (XII) acid salts of aromatic imines, such as (1) ephedrine hydrochloride $C_6H_5CH[CH(NHCH_3)CH_3]OH.HCl$ (Aldrich 28,574-9; 86,223-1); (2) ephedrine nitrate $C_6H_5CH[CH(NHCH_3)CH_3]OH.HNO_3$ (Aldrich 86,039-5); (3) (1S,2S)-(+)-pseudoephedrine hydrochloride $C_6H_5CH[CH(NHCH_3)CH_3]OH.HCl$ (Aldrich 29,461-6); (4) (±) 4-hydroxyephedrine hydrochloride $HOC_6H_4CH(OH)CH(CH_3)NHCH_3.HCl$ (Aldrich 10,615-1); (5) (±) isoproternenol hydrochloride $3,4-(HO)_2C_6H_3CH(OH)CH_2NHCH(CH_3)_2.HCl$ (Aldrich I-2,790-2); (6) (±)-propranolol hydrochloride $C_{10}H_7OCH_2CH(OH)CH_2NHCH(CH_3)_2.HCl$ (Aldrich 22,298-4); (7) chlorohexidine diacetate hydrate $[-(CH_2)_3NHC{=}NH)NHC({=}NH)NHC_6H_4Cl]_2.2CH_3COOH.xH_2O$ (Aldrich 23,386-2); (8) (±)-2-(methyl amino)propiophenone hydrochloride $C_6H_5COCH(CH_3)NHCH_3.HCl$ (Aldrich 31,117-0); (9) 4-methyl aminophenol sulfate $(CH_3NHC_6H_4OH)_2.H_2SO_4$ (Aldrich 32,001-3); (10) methyl benzimidate hydrochloride $C_6H_5C({=}NH)OCH_3.HCl$ (Aldrich 22,051-5); (11) (±)-metanephrine hydrochloride $HOC_6H_3(OCH_3)CH(CH_2NHCH_3)OH.HCl$ (Aldrich 27,428-3); (12) malonaldehyde bis(phenyl imine) dihydrochloride $CH_2(CH{=}NC_6H_5)_2.2HCl$ (Aldrich 34,114-2); (13) (±)-ketamine hydrochloride $ClC_6H_4C_6H_8({=}O)NHCH_3.HCl$ (Aldrich 34,309-9); (14) (±)-isoproterenol sulfate dihydrate $[3,4-(HO)_2C_6H_3CH(OH)CH_2NH(CH_3)_2]_2.H_2SO_4.2H_2O$ (Aldrich 10,044-7); (15) isoproterenol L-bitartrate $3,4-(HO)_2C_6H_3CH(OH)CH_2NH(CH_3)_2HOOCCH(OH)CH(OH)COOH$ (Aldrich 18,881-6); (16) diphenyhydramine hydrochloride $(C_6H_5)_2CHOCH_2CH_2N(CH_3)_2.HCl$ (Aldrich 28,566-8); (17) 3-dimethylamino propiophenone hydrochloride $C_6H_5COCH_2CH_2N(CH_3)_2.HCl$ (Aldrich D14,480-0); (18) neostigmine bromide $3-[(CH_3)_2NCOO]C_6H_4N(CH_3)_3Br$ (Aldrich 28,679-6); (19) neostigmine methyl sulfate $3-[(CH_3)_2NCOO]C_6H_4N(CH_3)_3(OSO_3CH_3)$ (Aldrich 28,681-8); (20) orphenadrine hydrochloride $CH_3C_6H_4CH(C_6H_5)OCH_2CH_2N(CH_3)_2.HCl$ (Aldrich 13,128-8); and the like.

Examples of suitable quaternary choline halides include (1) choline chloride [(2-hydroxyethyl)trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl)trimethyl ammonium chloride [bromo choline chloride] $BrCH_2CH_2N(CH_3)_3Br$ (Aldrich 11,719-6); (9) (2-chloro ethyl)trimethyl ammonium chloride [chloro choline chloride) $ClCH_2CH_2N(CH_3)_3Cl$ (Aldrich 23,443-5); (10) (3-carboxy propyl) trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$ (Aldrich B 10,425-6); (13) S-propionyl thiocholine iodide $C_2H_5COSCH_2CH_2N(CH_3)I$ (Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[-(CH_2)_3COOCH_2CH_2N(CH_3)_3Cl]_2$ (Aldrich 86,204-5) and suberyl dicholine diiodide $[-(CH_2)_3COOCH_2CH_2N(CH_3)_3I]_2$ (Aldrich 86,211-8); and the like, as well as mixtures thereof.

Also suitable as antistatic agents are pyrrole and pyrrolidine acid salt compounds, of the general formulae

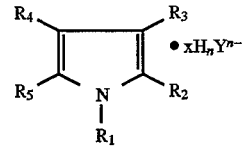

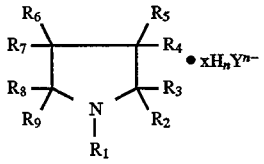

wherein $R_1$, $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrrole and pyrrolidine acid salt compounds include (1) 1-amino pyrrolidine hydrochloride (Aldrich 12,310-2), of the formula:

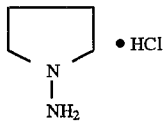

(2) 2-(2-chloroethyl)-1-methyl pyrrolidine hydrochloride (Aldrich 13,952-1), of the formula:

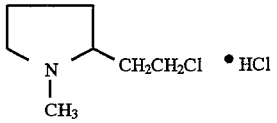

(3) 1-(2-chloroethyl)pyrrolidine hydrochloride (Aldrich C4,280-7), of the formula:

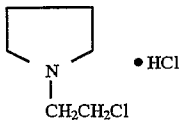

(4) L-proline methyl ester hydrochloride (Aldrich 28,706-7), of the formula:

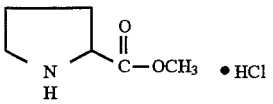

(5) tremorine dihydrochloride [1,1'-(2-butynylene) dipyrrolidine hydrochloride] (Aldrich T4,365-6), of the formula:

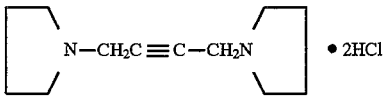

(6) ammonium pyrrolidine dithiocarbamate (Aldrich 14,269-7), of the formula:

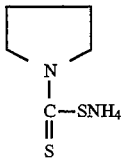

(7) pyrrolidone hydrotribromide (Aldrich 15,520-9), of the formula:

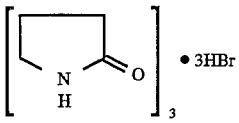

(8) 1-(4-chlorobenzyl)-2-(1-pyrrolidinyl methyl) benzimidazole hydrochloride (Aldrich 34,208-4), of the formula:

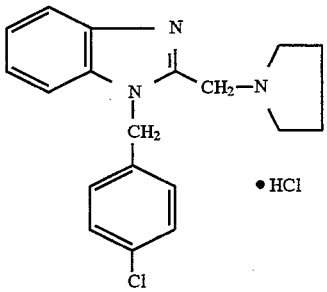

(9)billverdin dihydrochloride (Aldrich 25,824-5), of the formula:

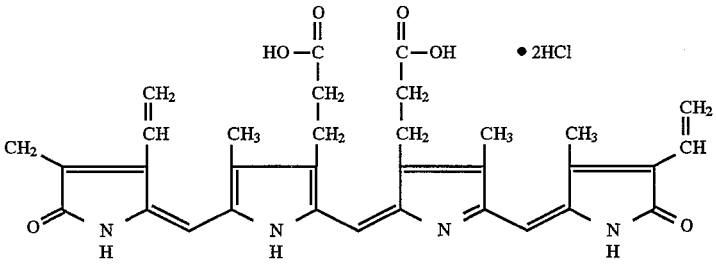

and the like.

Also suitable as antistatic agents are pyridine acid salt compounds, of the general formula

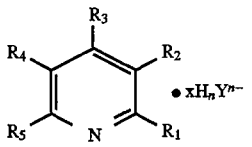

wherein $R_1$, $R_2$, $R_3$, $R_4$, and $R_5$ each, independently from one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, and $R_5$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_{43-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyridine acid salt compounds include (1) pyridine hydrobromide (Aldrich 30,747-5), of the formula:

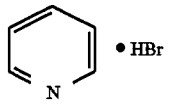

(2) pyridine hydrochloride (Aldrich 24,308-6), of the formula:

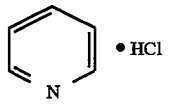

(3) 2-(chloromethyl)pyridine hydrochloride (Aldrich 16,270-1), of the formula:

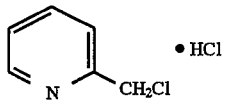

(4) 2-pyridylacetic acid hydrochloride (Aldrich P6,560-6), of the formula:

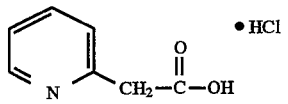

(5) nicotinoyl chloride hydrochloride (Aldrich 21,338-1), of the formula:

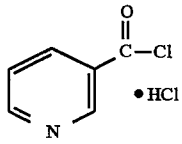

(6) 2-hydrazinopyridine dihydrochloride (Aldrich H1,710-4), of the formula:

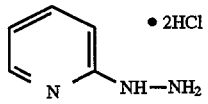

(7) 2-(2-methyl aminoethyl)pyridine dihydrochloride (Aldrich 15,517-9), of the formula:

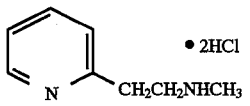

(8) 1-methyl-1,2,3,6-tetrahydropyridine hydrochloride (Aldrich 33,238-0), of the formula:

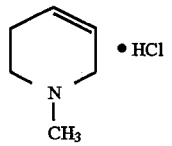

(9) 2,6-dihydroxypyridine hydrochloride (Aldrich D12,000-6), of the formula:

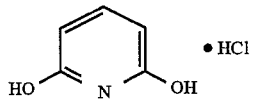

(10) 3-hydroxy-2(hydroxymethyl)pyridine hydrochloride (Aldrich H3,153-0), of the formula:

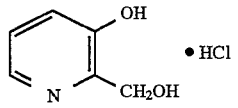

(11) pyridoxine hydrochloride (Aldrich 11,280-1), of the formula:

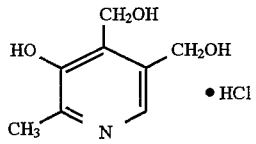

(12) pyridoxal hydrochloride (Aldrich 27,174-8), of the formula:

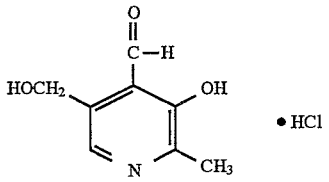

(13) pyridoxal 5-phosphate monohydrate (Aldrich 85,786-6), of the formula:

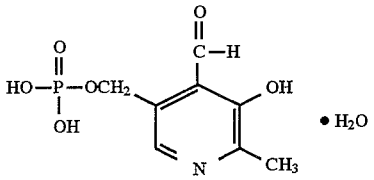

(14) 3-amino-2,6-dimethoxy pyridine hydrochloride (Aldrich 14,325-1), of the formula:

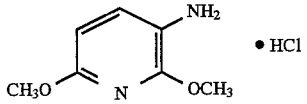

(15) pyridoxamine dihydrochloride monohydrate (Aldrich 28,709-1), of the formula:

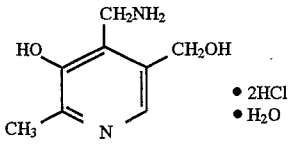

(16) iproniazid phosphate (isonicotinic acid 2-isopropyl hydrazide phosphate) (Aldrich I-1,265-4), of the formula:

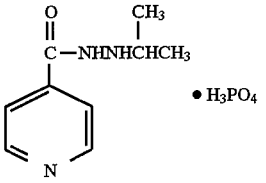

(17) tripelennamine hydrochloride (Aldrich 28,738-5), of the formula:

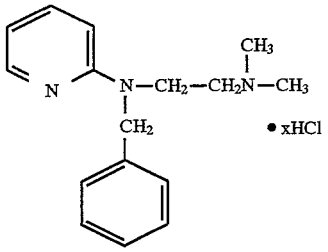

and the like.

Also suitable as antistatic agents are piperidine and homopiperidine acid salt compounds, of the general formulae

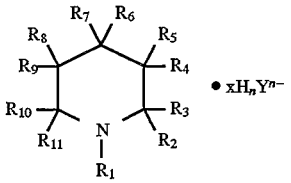

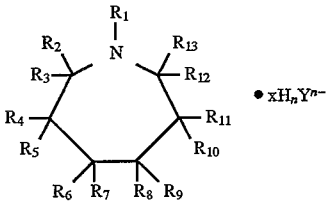

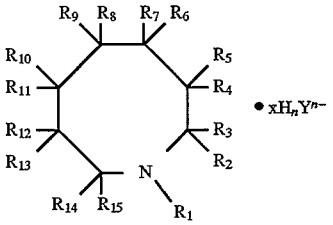

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^-$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable piperidine and homopiperidine acid salts include (1) 2-(hexamethylene imino)ethyl chloride monohydrochloride (Aldrich $H_{1,065-7}$), of the formula:

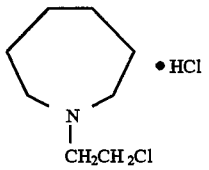

(2) 3-(hexahydro-1H-azepin-1-yl)-3'-nitropropiophenone hydrochloride (Aldrich 15,912-3), of the formula:

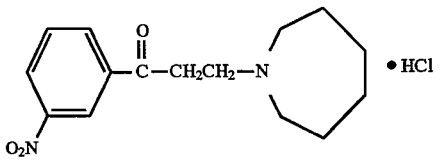

(3) imipramine hydrochloride [5-(3-dimethyl aminopropyl) -10,11-dihydro 5H-dibenz-(b,f)azepine hydrochloride] (Aldrich 28,626-5), of the formula:

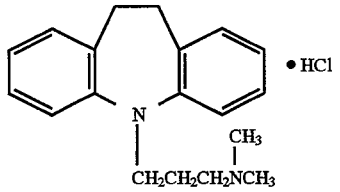

(4) carbamezepine [5H-dibenzo(b,f)-azepine-5-carboxamide] (Adlrich 30,948-6), of the formula:

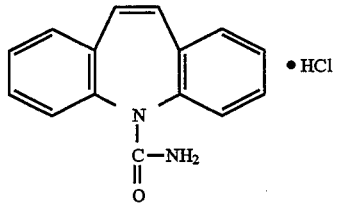

(5) 5,6,11,12-tetrahydro dibenz[b,f]azocine hydrochloride (Aldrich 18,761-5), of the formula:

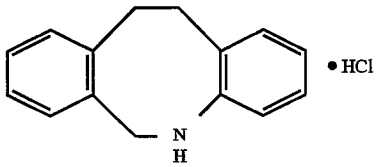

(6) 2-iminopiperidine hydrochloride (Aldrich 13,117-2), of the formula:

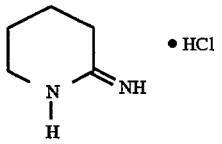

and the like.

Also suitable as antistatic agents are quinoline and isoquinoline acid salt compounds, of the general formulae:

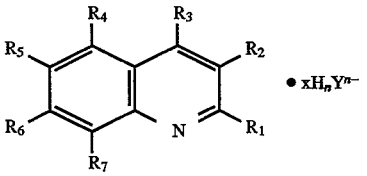

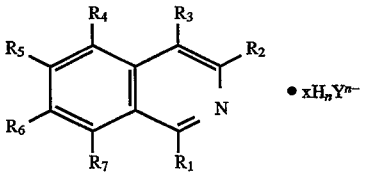

wherein $R_1$, $R_2$, $R_3$, $R_4$, $R_5$, $R_6$, and $R_7$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable quinoline and isoquinoline acid salt compounds include (1) 8-hydroxyquinoline hemisulfate hemihydrate (Aldrich 10,807-3), of the formula:

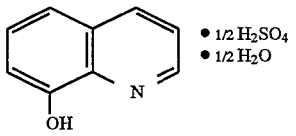

(2) 5-amino-8-hydroxy quinoline dihydrochloride (Aldrich 30,552-9), of the formula:

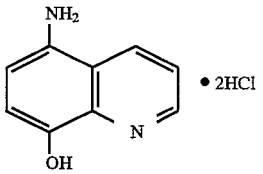

(3) 2-(chloromethyl)quinoline monohydrochloride (Aldrich C5,710-3), of the formula:

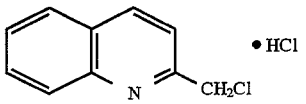

(4) 8-hydroxyquinoline-5-sulfonic acid monohydrate (Aldrich H5,875-7), of the formula:

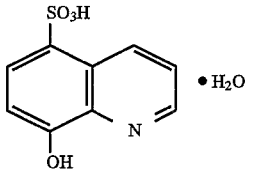

(5) 8-ethoxy-5-quinoline sulfonic acid sodium salt hydrate (Aldrich 17,346-0), of the formula:

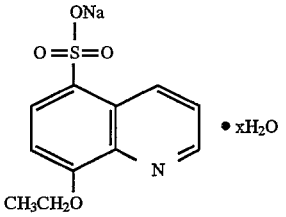

(6) 1,2,3,4-tetrahydroisoquinoline hydrochloride (Aldrich 30,754-8), of the formula:

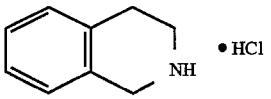

(7) 1,2,3,4-tetrahydro-3-isoquinoline carboxylic acid hydrochloride (Aldrich 21,493-0), of the formula:

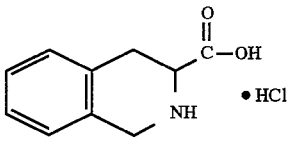

(8) 6,7-dimethoxy-1,2,3,4-tetrahydro isoquinoline hydrochloride (Aldrich 29,191-9), of the formula:

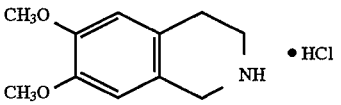

(9) 1-methyl-6,7-dihydroxy-1,2,3,4-tetrahydro isoquinoline hydrobromide (Aldrich 24,420-1), of the formula:

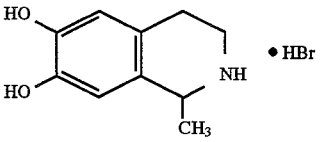

(10) primaquine diphosphate [8-(4-amino-1-methyl butyl amino)-6-methoxy quinoline diphosphate] (Aldrich 16,039-3), of the formula:

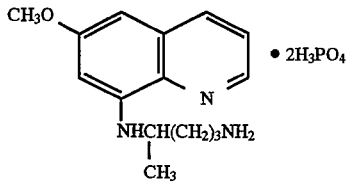

(11) pentaquine phosphate (Aldrich 30,207-4), of the formula:

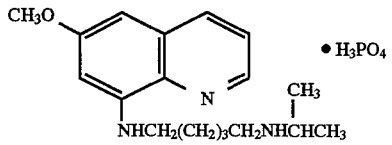

(12) dibucaine hydrochloride [2-butoxy-N-(2-diethyl amino ethyl)-4-quinoline carboxamide hydrochloride] (Aldrich 28,555-2), of the formula:

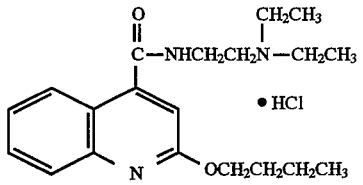

(13) 9-aminoacridine hydrochloride hemihydrate (Aldrich A3,840-1), of the formula:

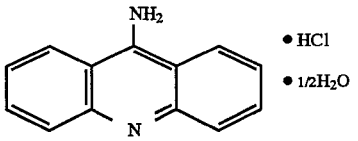

(14) 3,6-diamino acridine hemisulfate (Aldrich 19,822-6), of the formula:

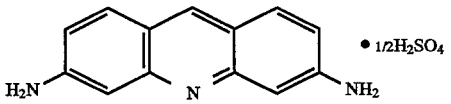

(15) 2-quinoline thiol hydrochloride (Aldrich 35,978-5), of the formula:

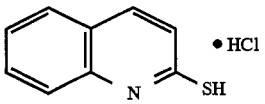

(16) (−) sparteine sulfate pentahydrate (Aldrich 23,466-4), of the formula:

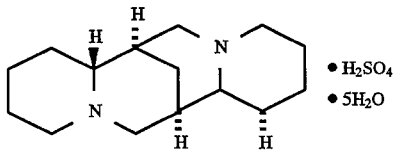

(17) papaverine hydrochloride (Aldrich 22,287-9), of the formula:

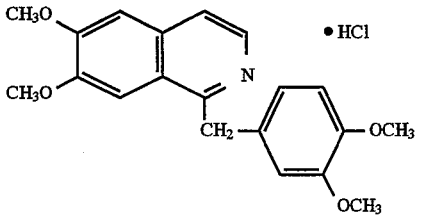

(18) (+)-emetine dihydrochloride hydrate (Aldrich 21,928-2), of the formula:

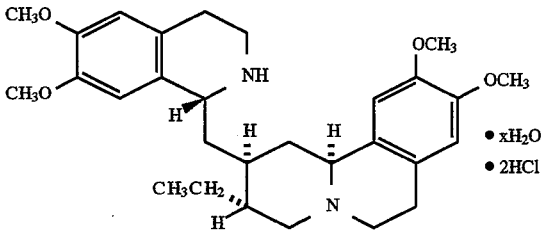

(19) 1,10-phenanthroline monohydrochloride monohydrate (Aldrich P1,300-2), of the formula:

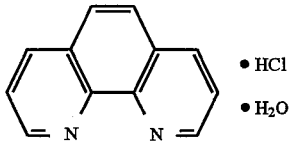

(20) neocuproine hydrochloride trihydrate (Aldrich 12,189-6), of the formula:

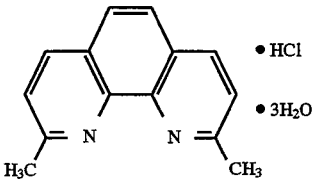

and the like.

Also suitable as antistatic agents are quinuclidine acid salt compounds, of the general formula

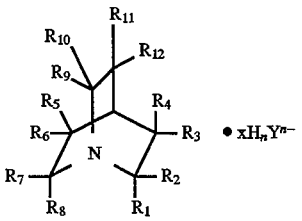

wherein $R_1$, $R_2$, $R_3$, $R_4$, $R_5$, $R_6$, $R_7$, $R_8$, $R_9$, $R_{10}$, $R_{11}$, and $R_{12}$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable quinuclidine acid salt compounds include (1) quinuclidine hydrochloride (Aldrich 13,591-7), of the formula:

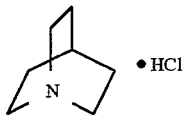

(2) 3-quinuclidinol hydrochloride (Aldrich Q188-3), of the formula:

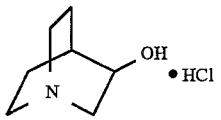

(3) 3-quinuclidinone hydrochloride (Aldrich Q190-5), of the formula:

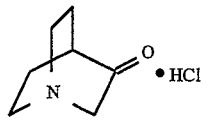

(4) 2-methylene-3-quinuclidinone dihydrate hydrochloride (Aldrich M4,612-8), of the formula:

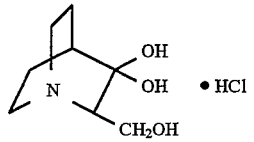

(5) 3-amino quinuclidine dihydrochloride (Aldrich 10,035-8), of the formula:

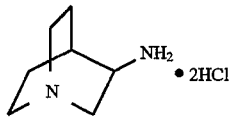

(6) 3-chloro quinuclidine hydrochloride (Aldrich 12,521-0), of the formula:

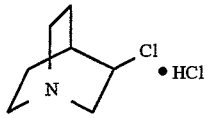

(7) quinidine sulfate dihydrate (Aldrich 14,589-0), of the formula:

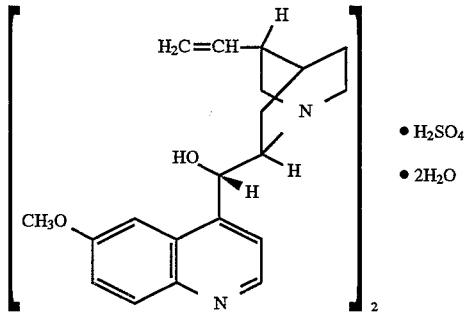

(8) quinine monohydrochloride dihydrate (Aldrich 14,592-0), of the formula:

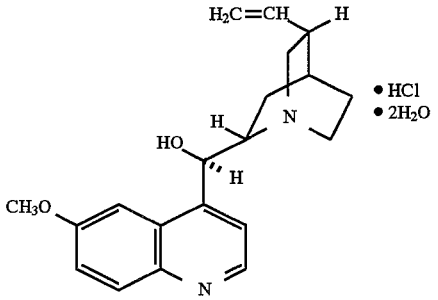

(9) quinine sulfate monohydrate (Aldrich 14,591-2), of the formula:

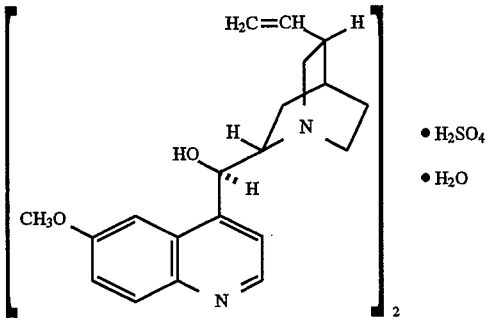

(10) hydroquinidine hydrochloride (Aldrich 25,481-9), of the formula:

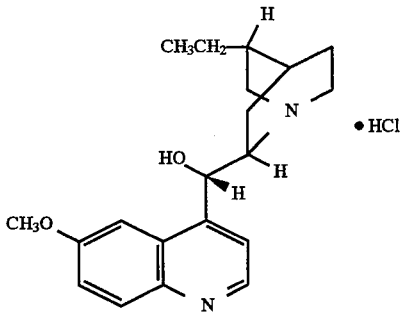

(11) hydroquinine hydrobromide dihydrate (Aldrich 34,132-0), of the formula:

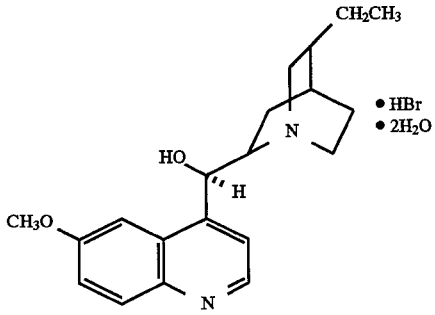

and the like.

Also suitable as antistatic agents are indole and indazole acid salt compounds, of the general formulae

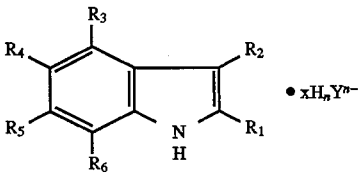

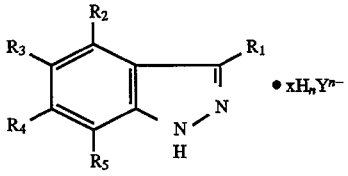

wherein $R_1$, $R_2$, $R_3$, $R_4$, $R_5$, and $R_6$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable indole and indazole acid salt compounds include (1) tryptamine hydrochloride (Aldrich 13,224-1), of the formula:

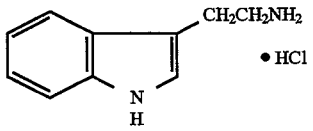

(2) 5-methyl tryptamine hydrochloride (Aldrich 13,422-8), of the formula:

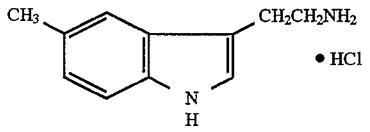

(3) serotonin hydrochloride hemihydrate (5-hydroxy tryptamine hydrochloride hemihydrate) (Aldrich 23,390-0), of the formula:

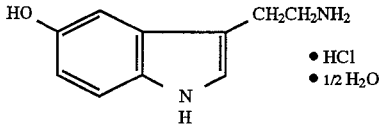

(4) norharman hydrochloride monohydrate (Aldrich 28,687-7), of the formula:

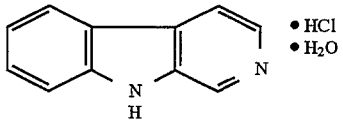

(5) harmane hydrochloride monohydrate (Aldrich 25,051-1), of the formula:

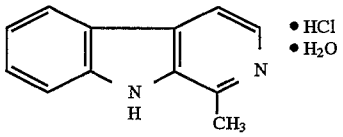

(6) harmine hydrochloride hydrate (Aldrich 12,848-1), of the formula:

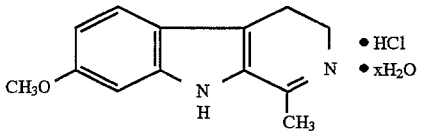

(7) harmaline hydrochloride dihydrate (Aldrich H 10-9), of the formula:

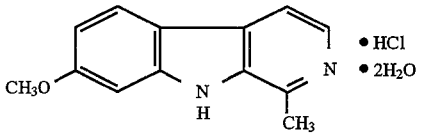

(8) harmol hydrochloride dihydrate (Aldrich 11,655-6), of the formula:

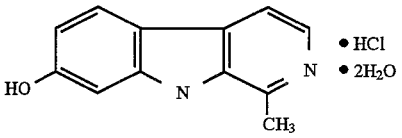

(9) harmalol hydrochloride dihydrate (Aldrich H12-5), of the formula:

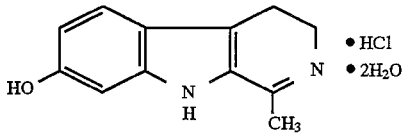

(10) 3,6-diamino acridine hydrochloride (Aldrich 13,110-5), of the formula:

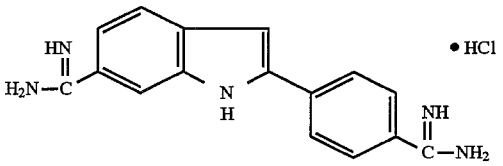

(11) S-(3-indolyl)isothiuronium iodide (Aldrich 16,097-0), of the formula:

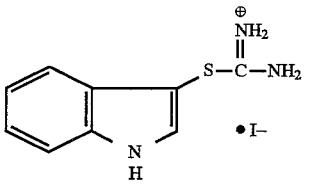

(12) yohimbine hydrochloride (Aldrich Y20-8), of the formula:

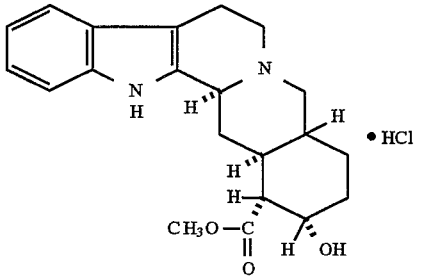

(13) 4,5-dihydro-3-(4-pyridinyl)-2H-benz[g]indazole methane sulfonate (Aldrich 21,413-2), of the formula:

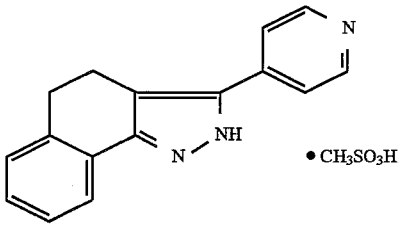

and the like.

Also suitable as antistatic agents are pyrimidine acid salt compounds, of the general formula

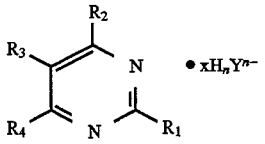

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrimidine acid salt compounds include (1) 2-hydroxypyrimidine hydrochloride (Aldrich H5,740-8), of the formula:

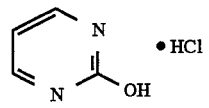

(2) 2-hydroxy-4-methyl pyrimidine hydrochloride (Aldrich H4,320-2), of the formula:

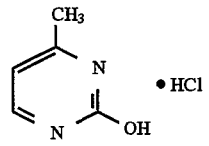

(3) 4,6-dimethyl-2-hydroxypyrimidine hydrochloride (Aldrich 33,996-2), of the formula:

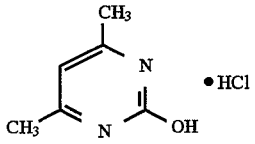

(4) 2-mercapto-4-methyl pyrimidine hydrochloride (Aldrich M480-5), of the formula:

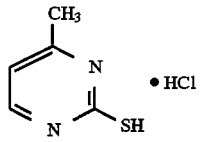

(5) 4,6-diamino pyrimidine hemisulfate monohydrate (Aldrich D2,480-3), of the formula:

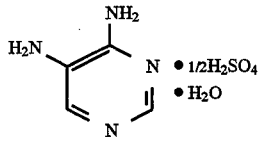

(6) 4,5,6-triamino pyrimidine sulfate hydrate (Aldrich T4,600-0; 30,718-1), of the formula:

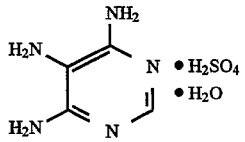

(7) 4,5-diamino-6-hydroxy pyrimidine sulfate (Aldrich D1,930-3), of the formula:

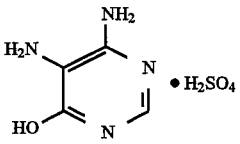

(8) 2,4-diamino-6-mercapto pyrimidine hemisulfate (Aldrich D1,996-6), of the formula:

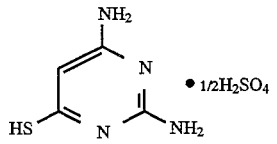

(9) 2,4-diamino-6-hydroxy pyrimidine hemisulfate hydrate (Aldrich 30,231-7); of the formula:

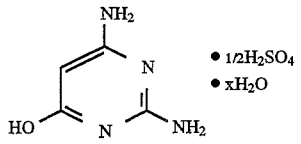

(10) 6-hydroxy-2,4,5-triamino pyrimidine sulfate (Aldrich H5,920-6), of the formula:

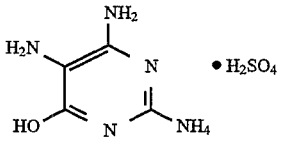

(11) 5,6-diamino-2,4-dihydroxy pyrimidine sulfate (Aldrich D1,510-3), of the formula:

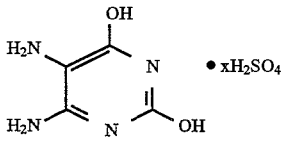

(12) $N^4$-(2-amino-4-pyrimidinyl)sulfanilamide monohydrochloride (Aldrich 15,237-4), of the formula:

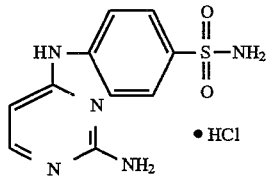

(13) 4,5,6-triamino-2(1H)-pyrimidinethione sulfate (Aldrich 26,096-7), of the formula:

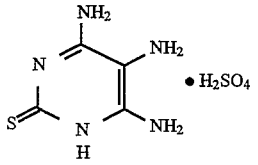

(14) 2,4,5,6-tetraamino pyrimidine sulfate (Aldrich T380-7), of the formula:

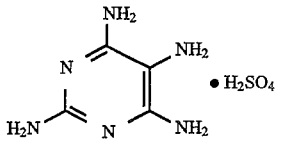

(15) (−)-cyclocytidine hydrochloride (Aldrich 85,883-8), of the formula:

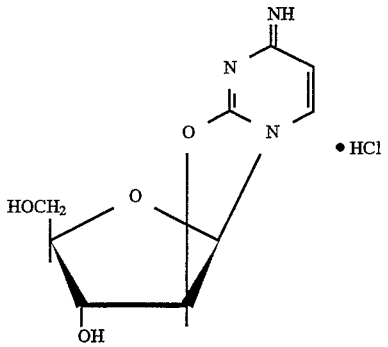

(16) cytosine arabinoside hydrochloride (Aldrich 85,585-5), of the formula:

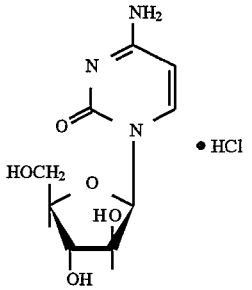

and the like.

Also suitable as antistatic agents are pyrazole acid salt compounds, of the general formula

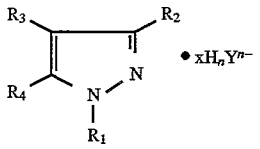

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrazole acid salt compounds include (1) 4-methyl pyrazole hydrochloride (Aldrich 28,667-2)

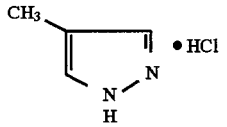

(2) 3,4-diamino-5-hydroxy pyrazole sulfate (Aldrich D1,900-1)

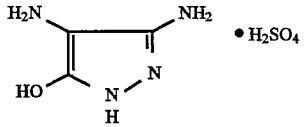

(3) (3,5-dimethyl pyrazole-1-carboxamidine nitrate) (Aldrich D18,225-7)

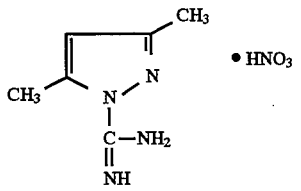

(4) 3-amino-4-pyrazole carboxamide hemisulfate (Aldrich 15,305-2)

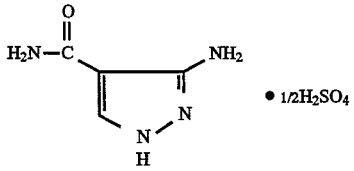

(5) acid salt of 6-amino indazole hydrochloride (Aldrich A5, 955-7)

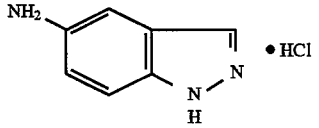

and the like.

Also suitable as antistatic agents are oxazole and isoxazole acid salt compounds, of the general formulae

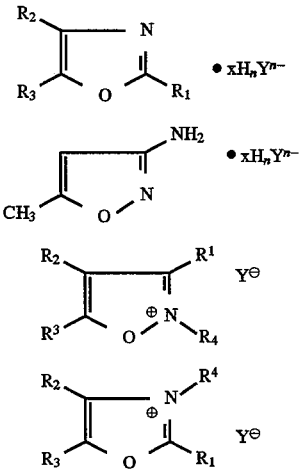

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable oxazole and isoxazole acid salt compounds include (1) 3,3'-dimethyl oxacarbocyanine iodide (Aldrich 32,069-2), of the formula:

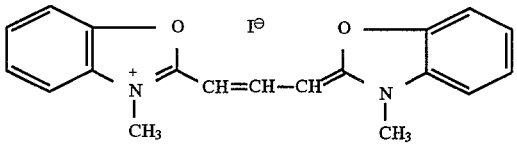

(2) 2-ethyl-5-phenyl isoxazolium-3'-sulfonate (Aldrich E4,526-0), of the formula:

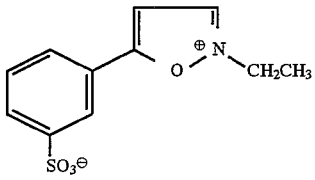

(3) 2-chloro-3-ethylbenzoxazolium tetrafluoroborate (Aldrich 23,255-6), of the formula:

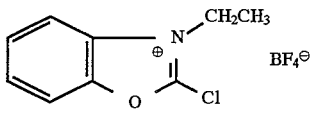

(4) 2-tert-butyl-5-methyl isoxazolium perchlorate (Aldrich B9,695-3), of the formula:

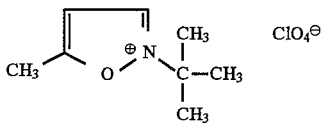

(5) 5-phenyl-2-(4-pyridyl)oxazole hydrochloride hydrate (Aldrich 23,748-5), of the formula:

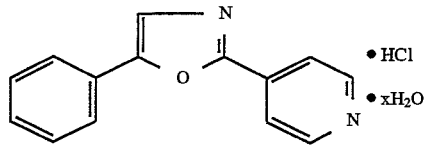

(6) 5-phenyl-2-(4-pyridyl)oxazole methyl tosylate salt (Aldrich 23,749-3), of the formula:

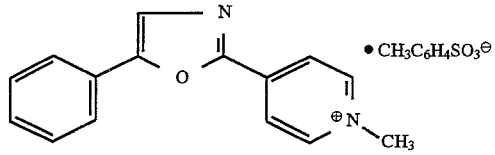

and the like.

Also suitable as antistatic agents are morpholine acid salt compounds, of the general formula

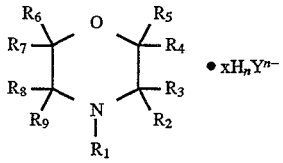

wherein $R_1$, $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^-$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable morpholine acid salt compounds include (1) 4-(2-chloroethyl)morpholine hydrochloride (Aldrich C4,220-3), of the formula:

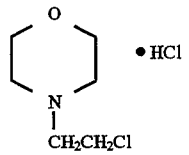

(2) 4-morpholine ethane sulfonic acid (Aldrich 16,373-2), of the formula:

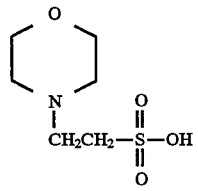

(3) 4-morpholine propane sulfonic acid (Aldrich 16,377-5), of the formula:

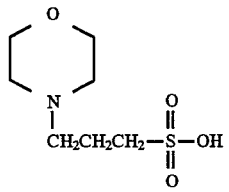

(4) β-hydroxy morpholine propane sulfonic acid (Aldrich 28,481-5), of the formula:

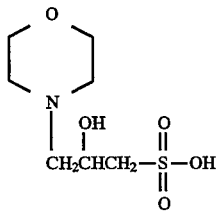

(5) [N-(aminoiminomethyl)-4-morpholine carboximidamide]hydrochloride (Aldrich 27,861-0), of the formula:

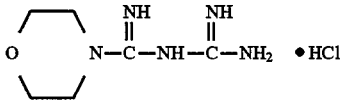

(6) 4-morpholine carbodithioic acid compound with morpholine (Aldrich 32,318-7), of the formula:

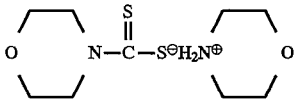

(7) 2,5-dimethyl-4-(morpholinomethyl)phenol hydrochloride monohydrate (Aldrich 18,671-6), of the formula:

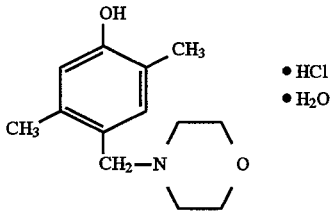

(8) 2-methoxy-4-morpholino benzene diazonium chloride, zinc chloride (Aldrich M1,680-6), of the formula:

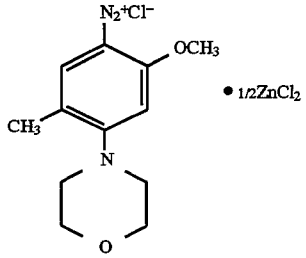

(9) 1-cyclohexyl-3-(2-morpholinoethyl)carbodiimide metho-p-toluene sulfonate (Aldrich C10,640-2), of the formula:

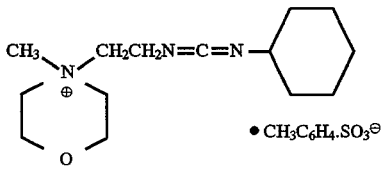

(10) hemicholinium-3[2,2'-(4,4'-biphenylene)bis(2-hydroxy-4,4-dimethyl morpholinium bromide) (Aldrich H30,3), of the formula:

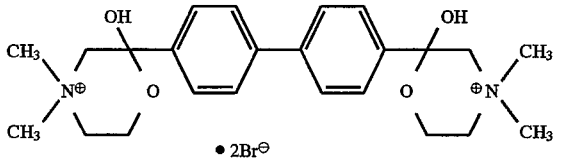

(11) hemicholinium-15[4,4-dimethyl-2-hydroxy-2-phenyl morpholinium bromide] (Aldrich 11,603-3), of the formula:

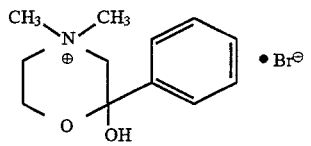

and the like.

Also suitable as antistatic agents are thiazole, thiazolidine, and thiadiazole acid salt compounds, of the general formulae

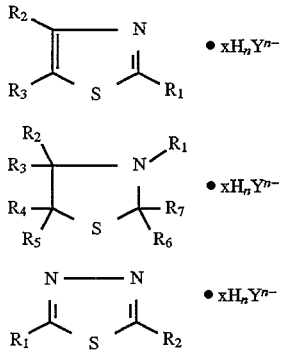

wherein $R_1$, $R_2$, $R_3$, $R_4$, $R_5$, $R_6$, and $R_7$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^-$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable thiazole, thiazolidine, and thiadiazole acid salt compounds include (1) 2-amino-4,5-dimethyl thiazole hydrochloride (Aldrich 17,440-8), of the formula:

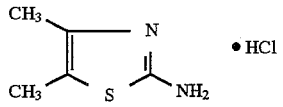

(2) 2-amino 4-imino-2-thiazoline hydrochloride (Aldrich 13,318-3), of the formula:

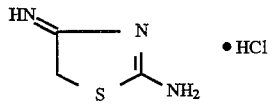

(3) 2-amino-2-thiazoline hydrochloride (Aldrich 26,372-9), of the formula:

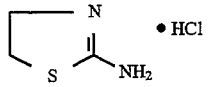

(4) 2-amino-5-bromothiazole monohydrobromide (Aldrich 12,802-3), of the formula:

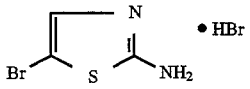

(5) 5-amino-3-methyl isothiazole hydrochloride (Aldrich 15,564-0), of the formula:

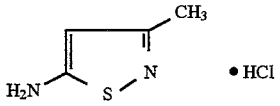

(6) 2,2,5,5-tetramethyl-4-thiazolidine carboxylic acid hydrochloride hemihydrate (Aldrich P100-4), of the formula:

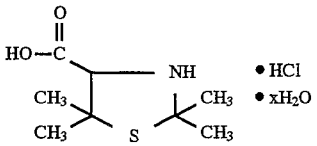

(7) 3-methyl-2-benzothiazolinone hydrazone hydrochloride hydrate (Aldrich 12,973-9), of the formula:

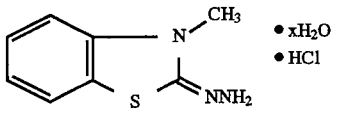

(8) 5-amino-2-methylbenzothiazole dihydrochloride (Aldrich A6,330-9), of the formula:

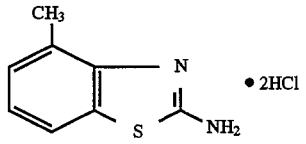

(9) 2,4-diamino-5-phenyl thiazole monohydrobromide (Aldrich D2,320-3), of the formula:

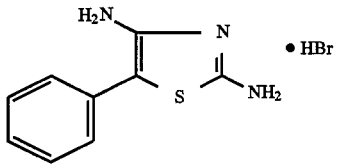

(10) 2-amino-4-phenyl thiazole hydrobromide monohydrate (Aldrich A7,500-5), of the formula:

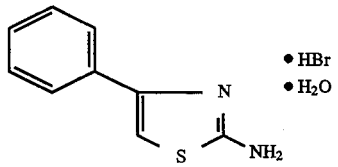

(11) 2-(tritylamino)-α-(methoxyimino)-4-thiazole acetic acid hydrochloride (Aldrich 28,018-6), of the formula:

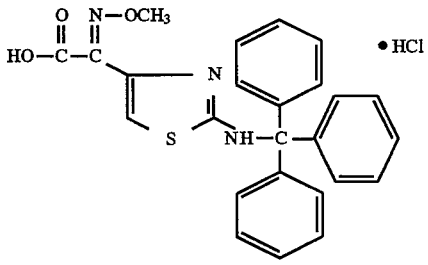

(12) (2,3,5,6-tetrahydro-6-phenylimidazo[2,1-b]thiazole hydrochloride (Aldrich 19,613-4; 19614-2), of the formula:

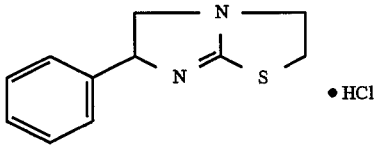

and the like.

Also suitable as antistatic agents are phenothiazine acid salt compounds, of the general formula

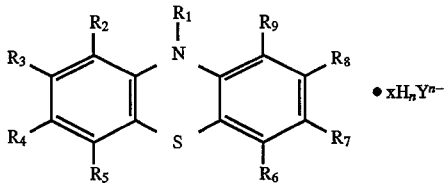

wherein $R_1$ $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable phenothiazine acid salt compounds include (1) trifluoroperazine dihydrochloride (Aldrich 28,388-6), of the formula:

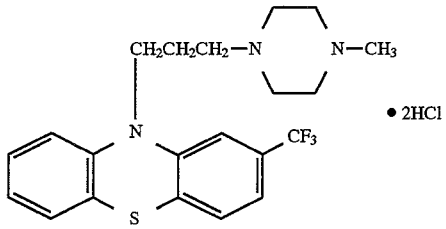

(2) thioridazine hydrochloride (Aldrich 25,770-2), of the formula:

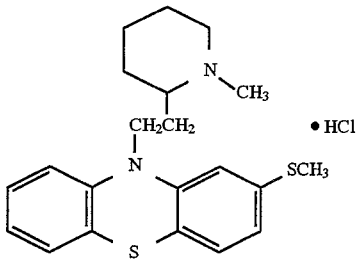

(3) (±)-promethazine hydrochloride (Aldrich 28,411-4), of the formula:

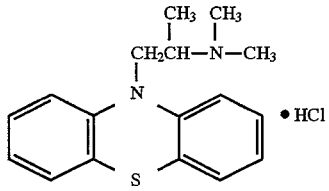

(4) ethopropazine hydrochloride (Aldrich 28,583-8), of the (formula:

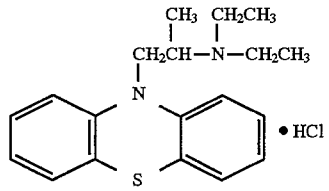

(5) chlorpromazine hydrochloride (Aldrich 28,537-4), of the formula:

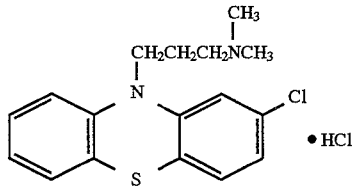

and the like.

Preferred antistatic agents are monomeric, although dimeric, trimeric, oligomeric, and polymeric antistatic agents can also be employed.

Further information concerning the structure, materials, and preparation of migration imaging members is disclosed in U.S. Pat. Nos. 3,975,195, 3,909,262, 4,536,457, 4,536,458, 4,013,462, 4,883,731, 4,123,283, 4,853,307, 4,880,715, U.S. application Ser. No. 590,959 (abandoned, filed Oct. 31, 1966), U.S. application Ser. No. 695,214 (abandoned, filed Jan. 2, 1968), U.S. application Ser. No. 000,172 (abandoned, filed Jan. 2, 1970), and P. S. Vincett, G. J. Kovacs, M. C. Tam, A. L. Pundsack, and P. H. Soden, *Migration Imaging Mechanisms, Exploitation, and Future Prospects of Unique Photographic Technologies*, XDM and AMEN, *Journal of Imaging Science* 30 (4) July/August, pp. 183–191 (1986), the disclosures of each of which are totally incorporated herein by reference.

The overcoating layer is of a substantially transparent material, and allows light to pass through the migration imaging member and enables the image in the developed member to be visible. The overcoating layer can be of any suitable or desired thickness, and typically is from about 0.2 to about 25 microns in thickness, preferably from about 0.5 to about 5 microns in thickness, although the thickness can be outside these ranges. Examples of suitable overcoating layer materials include those listed previously herein as suitable for transparent substrates. Another example is the lamination film available from Southwest Binding Systems, Scarborough, Ontario, Canada.

The overcoating layer is applied to the surface of the migration imaging member spaced from the substrate. When the migration imaging member is of the configuration illustrated in FIGS. 1 and 3, the overcoating layer is applied to the surface of the softenable layer. When the migration imaging member is of the configuration illustrated in FIG. 2, the overcoating layer is applied to the surface of the infrared-sensitive layer. The overcoating layer is applied to the migration imaging member subsequent to exposing the imaging member to activating radiation in an image pattern but prior to (or simultaneously with) development of the imaging member. The process is illustrated schematically in FIGS. 4 through 12A and 12B.

Figure 4:
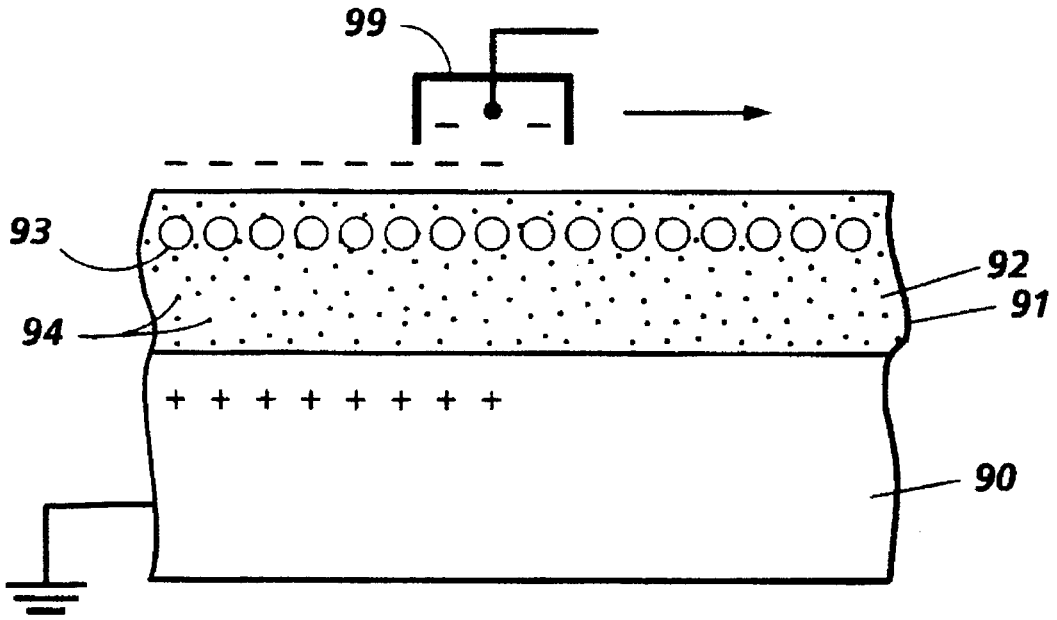
FIGS. 4, 5, and 6 illustrate schematically processes for imaging and developing a migration imaging member of the present invention.
Figure 5:
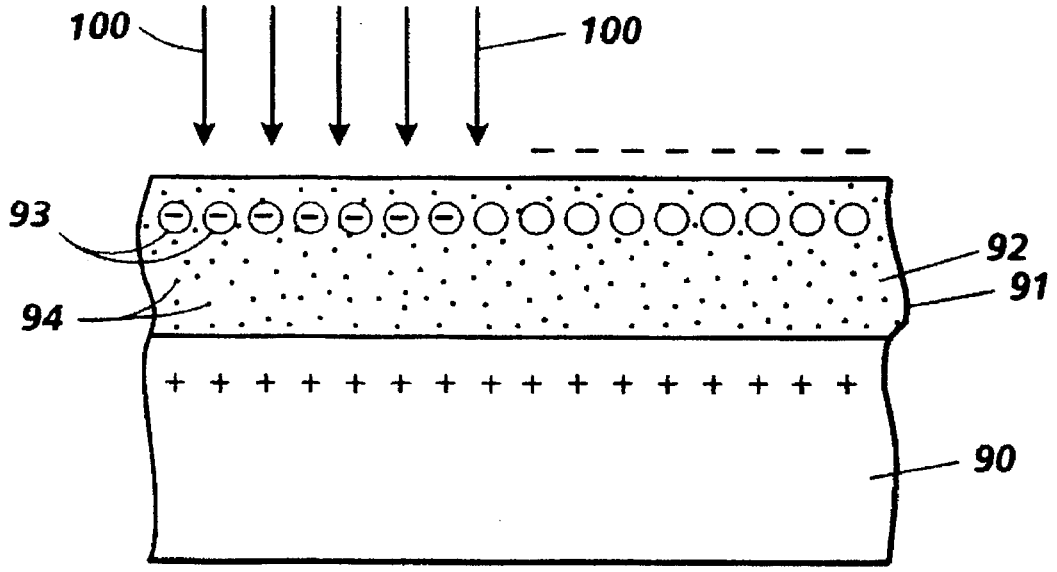
Figure 6:
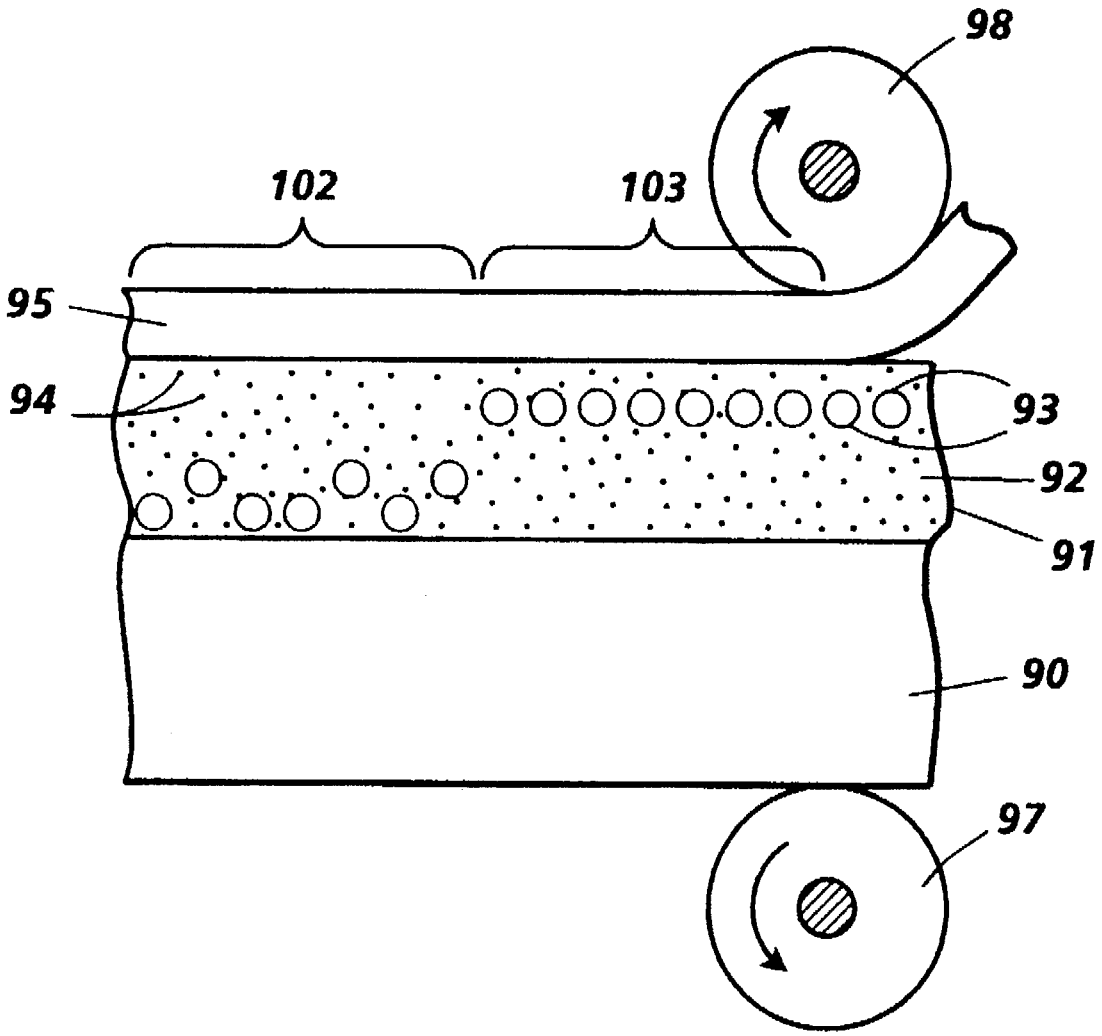

The process for imaging, developing, and overcoating an imaging member of the present invention as shown schematically in FIG. 1 is illustrated schematically in FIGS. 4, 5, and 6. FIGS. 4, 5, and 6 illustrate schematically a migration imaging member comprising a conductive substrate layer 90 that is connected to a reference potential such as a ground, and a softenable layer 91 comprising softenable material 92, migration marking material 93, and optional charge transport material 94. As illustrated schematically in FIG. 4, the member is uniformly charged in the dark to either polarity (negative charging is illustrated in FIG. 4) by a charging means 99 such as a corona charging apparatus.

As illustrated schematically in FIG. 5, the charged member is then exposed imagewise to radiation 100 at a wavelength to which the migration marking material 93 is sensitive. For example, when the migration marking material is selenium particles, blue or green light can be used for imagewise exposure. Substantial photodischarge then occurs in the exposed areas.

As illustrated schematically in FIG. 6, subsequent to formation of a charge image pattern, the imaging member is simultaneously overcoated and developed by causing the softenable material to soften by laying overcoating layer 95 onto the surface of the imaging member spaced from substrate 90 (in the illustrated embodiment, laying overcoating layer 95 onto the surface of softenable layer 91) and applying heat and pressure to the migration imaging member and overcoating layer by passing the "sandwich" created by laying overcoating layer 95 onto the imaging member through a nip created by roller 97 and roller 98. Heating can be accomplished by heating one or both of rollers 97 and 98. Alternatively (not shown), a heating element may be situated so as to heat the "sandwich" before it passes through the nip created by rollers 97 and 98. Rollers 97 and 98 are situated with respect to each other so as to form a nip, such that pressure is applied to softenable layer 91 and overcoating layer 95 while they are in intimate contact with each other. Thereafter, subsequent to exiting the nip formed by rollers 97 and 98, overcoating layer 95 adheres to softenable layer 91. Application of heat and pressure in the illustrated manner causes softenable material 92 to soften, thereby enabling migration marking material 93 to migrate through softenable material 92 toward substrate 90, and also causing overcoating layer 95 to adhere to softenable layer 91. The temperature and time depend upon factors such as the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material decreases in viscosity, thereby decreasing its resistance to migration of the marking material 93 through the softenable layer 91. As shown in FIG. 6, in areas 102 of the imaging member, wherein the migration marking material has a substantial net charge, upon softening of the softenable layer 91, the net charge causes the charged marking material to migrate in image configuration towards the conductive layer 90 and disperse in the softenable layer 91, resulting in a $D_{min}$ area. The uncharged migration marking particles in areas 103 of the imaging member remain essentially neutral and uncharged. Thus, in the absence of migration force, the unexposed migration marking particles remain substantially in their original position in softenable layer 91, resulting in a $D_{max}$ area.

The application of heat should be sufficient to decrease the resistance of the softenable material of softenable layer 91 to allow migration of the migration marking material 93 through softenable layer 91 in imagewise configuration. The test for a satisfactory combination of time and temperature is to maximize optical contrast density. The temperature of the "sandwich" and the pressure in the nip created by rollers 97 and 98 is selected so that overcoating layer 95 adheres to whichever layer is situated topmost on substrate 90 (which is softenable layer 91 as illustrated in FIG. 6) subsequent to exiting the nip. Preferred temperatures for heating typically are from about 70° to about 150° C., and more preferably from about 85° C. to about 110° C., although the temperature can be outside these ranges. Preferred pressures within the nip between rollers 97 and 98 typically are from about 0.1 to about 50 panels per square inch, although the pressure can be outside this range.

The imaging member illustrated in FIGS. 4, 5, and 6 is shown without any optional layers such as those illustrated in FIG. 1. If desired, alternative imaging member embodiments, such as those employing any or all of the optional layers illustrated in FIG. 1, can also be employed.

Figure 7A:
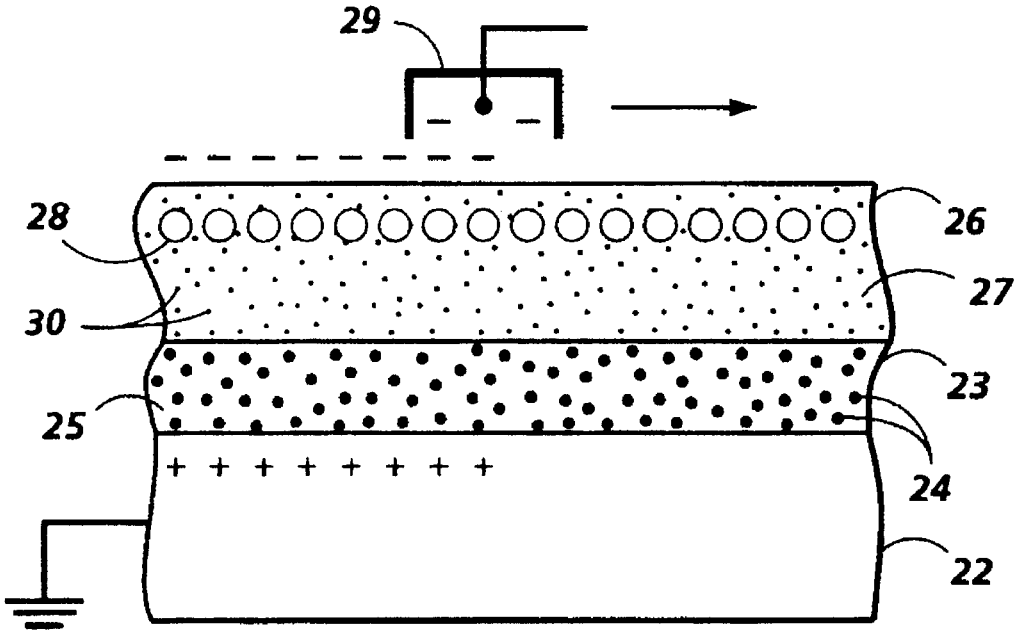
Figure 7B:
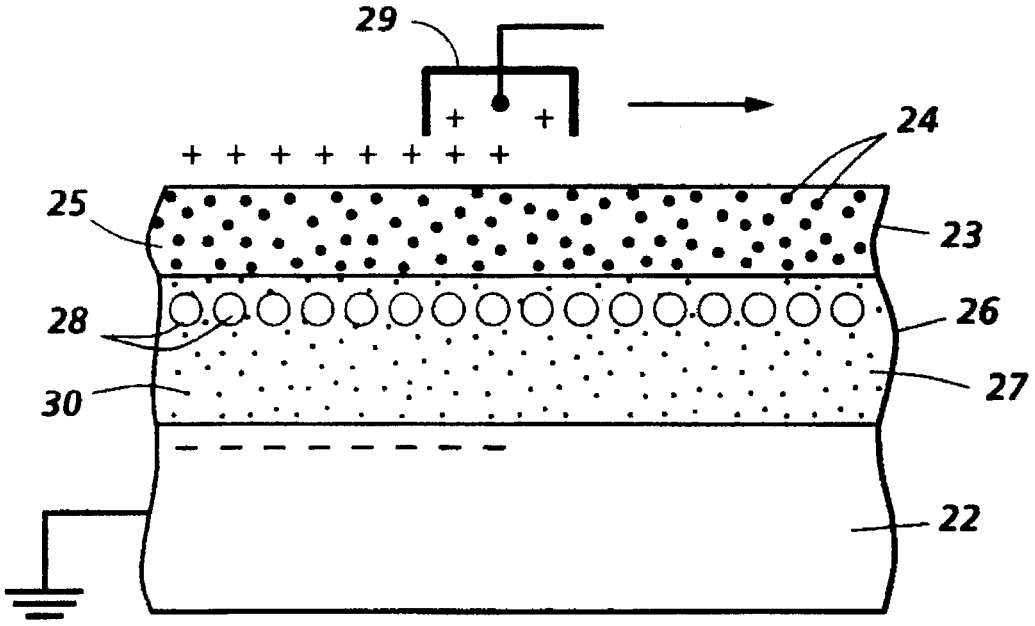

The process for imaging, developing, and overcoating an imaging member of the present invention as shown schematically in FIG. 2 or FIG. 3 by imagewise exposure to infrared or red radiation and developing a migration imaging member of the present invention is illustrated schematically in FIGS. 7A and 7B through 12A and 12B. The process illustrated schematically in FIGS. 7B, 8B, 9B, 9C, 10B, 11B, 11C, and 12B represents an embodiment of the present invention wherein the softenable layer is situated between the infrared or red light sensitive layer and the substrate and the softenable layer contains a charge transport material capable of transporting charges of one polarity. In the process steps illustrated in FIGS. 7B, 8B, 9B, 10B, and 11B, the imaging member is charged to the same polarity as that which the charge transport material in the softenable layer is capable of transporting; in the process steps illustrated schematically in FIGS. 9C and 11C, the imaging member is recharged to the polarity opposite to that which the charge transport material is capable of transporting. In FIGS. 7B, 8B, 9B, 9C, 10B, 11B, 11C, and 12B, the softenable material in the softenable layer contains a hole transport material (capable of transporting positive charges). FIGS. 7A and 7B through 12A and 12B illustrate schematically a migration imaging member comprising a conductive substrate layer 22 that is connected to a reference potential such as a ground, an infrared or red light sensitive layer 23 comprising infrared or red light sensitive pigment particles 24 dispersed in polymeric binder 25, and a softenable layer 26 comprising softenable material 27, migration marking material 28, and charge transport material 30. As illustrated in FIGS. 7A and B, the member is uniformly charged in the dark to either polarity (negative charging is illustrated in FIG. 7A, positive charging is illustrated in FIG. 7B) by a charging means 29 such as a corona charging apparatus.

Figure 8A:
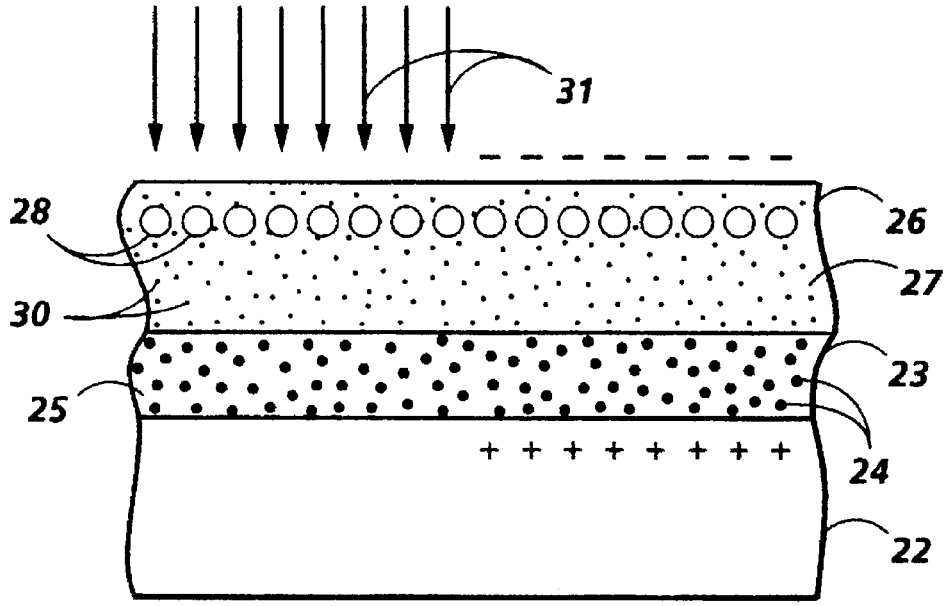
Figure 8B:
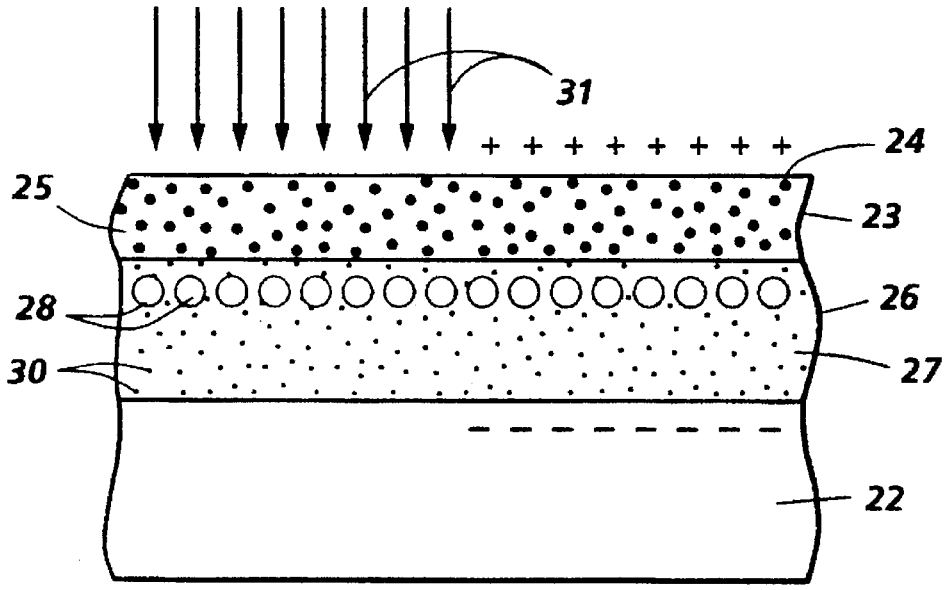

As illustrated schematically in FIGS. 8A and 8B, the charged member is first exposed imagewise to infrared or red light radiation 31. The wavelength of the infrared or red light radiation used is preferably selected to be in the region where the infrared or red-light sensitive pigments exhibit maximum optical absorption and maximum photosensitivity. When the softenable layer 26 is situated between the infrared or red light sensitive layer 23 and the radiation source 31, as shown in FIG. 8A, the infrared or red light radiation 31 passes through the non-absorbing migration marking material 28 (which is selected to be substantially insensitive to the infrared or red light radiation wavelength used in this step) and exposes the infrared or red light sensitive pigment particles 24 in the infrared or red light sensitive layer. Absorption of infrared or red light radiation by the infrared or red light sensitive pigment results in substantial photodischarge in the exposed areas. Thus the areas that are exposed to infrared radiation become substantially discharged. As shown in FIG. 8B, when the infrared or red light sensitive layer 23 is situated between the softenable layer 26 and the radiation source 31 and the member is charged to the same polarity as the charge transport material in the softenable layer is capable of transporting, absorption of infrared or red light radiation by the infrared or red light sensitive pigment results in substantial photodischarge in the exposed areas. Thus the areas that are exposed to infrared radiation become substantially discharged.

As illustrated schematically in FIGS. 9A and B, the charged member is subsequently exposed uniformly to activating radiation 32 at a wavelength to which the migration marking material 28 is sensitive. For example, when the migration marking material is selenium particles, blue or green light can be used for uniform exposure. As shown in FIG. 9A, when layer 26 is situated above layer 23, the uniform exposure to radiation 32 results in absorption of radiation by the migration marking material 28. (In the context of the present invention, "above" with respect to the ordering of the layers within the migration imaging member indicates that the layer is relatively nearer to the radiation source and relatively more distant from the substrate, and "below" with respect to the ordering of the layers within the migration imaging member indicates that the layer is relatively more distant from the radiation source and relatively nearer to the substrate.) In charged areas of the imaging member 35, the migration marking particles 28*a* acquire a negative charge as ejected holes (positive charges) discharge the surface charges, resulting in an electric field between the migration marking particles and the substrate. Areas 37 of the imaging member that have been substantially discharged by prior infrared or red light exposure are no longer sensitive, and the migration marking particles 28*b* in these areas acquire no or very little charge. As shown in FIG. 9B, when the infrared or red light sensitive layer 23 is situated above the softenable layer 26 and the member is charged to the same polarity as the charge transport material in the softenable layer is capable of transporting, uniform exposure to radiation 32 at a wavelength to which the migration marking material 28 is sensitive is largely absorbed by the migration marking material 28. The wavelength of the uniform light radiation is preferably selected to be in the region where the infrared or red-light sensitive pigments in layer 23 exhibit maximum light transmission and where the migration marking particles 28 exhibit maximum light absorption. Thus, in areas of the imaging member which are still charged, the migration marking particles 28*a* acquire a negative charge as ejected holes (positive charges) transport through the softenable layer to the substrate. Areas 37 of the imaging member that have been substantially discharged by prior infrared or red light exposure are no longer light sensitive, and the migration marking particles 28*b* in these areas acquire no or very little charge.

Figure 9C:
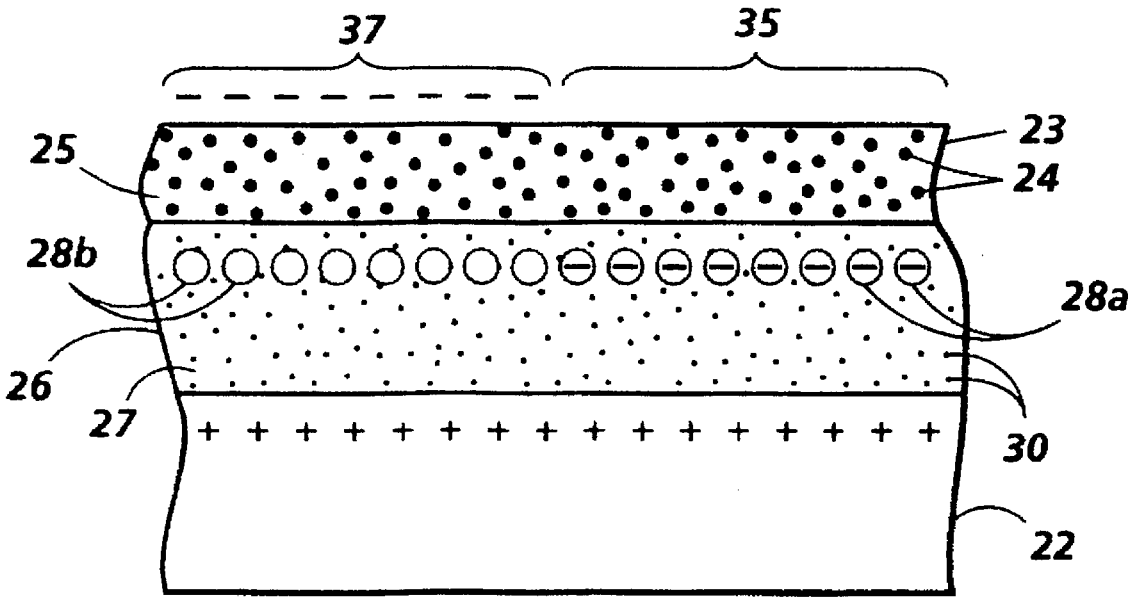

In the embodiment illustrated in FIG. 9B, the resulting charge pattern is such that the imaging member cannot be developed by heat development, since there is no substantial electric field between the migration marking materials and the substrate. As shown in FIG. 9C, the imaging member is further subjected to uniform recharging to a polarity opposite to that which the charge transport material in the softenable layer is capable of transporting (negative as illustrated in FIG. 9C), resulting in the migration marking material in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member.

It is important to emphasize that in general, the step of imagewise exposing the member to infrared or red light radiation and the step of uniformly exposing the member to radiation at a wavelength to which the migration marking material is sensitive can take place in any order. When the member is first imagewise exposed to infrared or red light radiation as illustrated in FIGS. 8A and 8B and subsequently uniformly exposed to radiation to which the migration marking material is sensitive as illustrated in FIGS. 9A, 9B, and 9C, the process proceeds as described with respect to FIGS. 8A, 8B, 9A, 9B, and 9C. When the member is first uniformly exposed to radiation to which the migration marking material is sensitive and subsequently imagewise exposed to infrared or red light radiation, the process proceeds as described with respect to FIGS. 10A, 10B, 11A, 11B, and 11C.

Figure 10A:
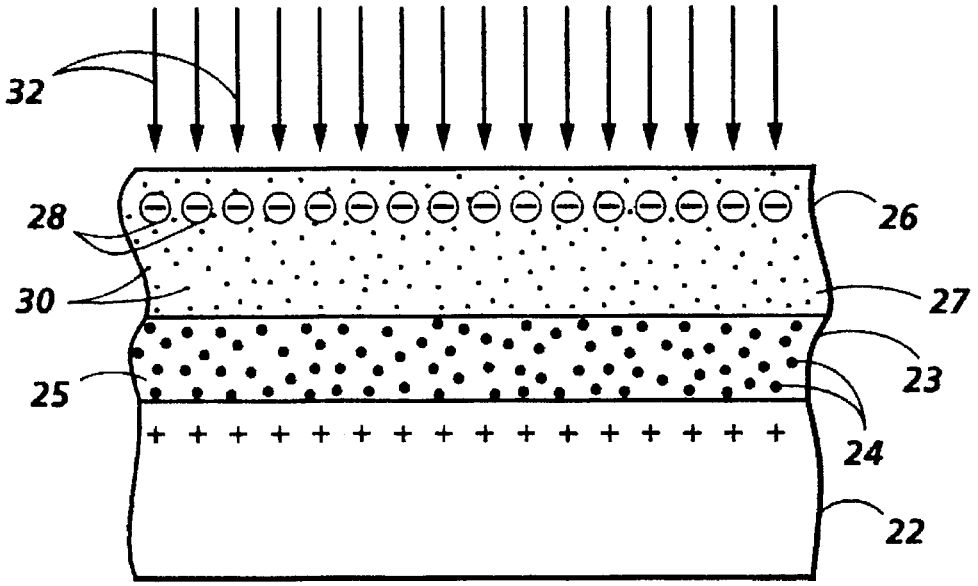
Figure 10B:
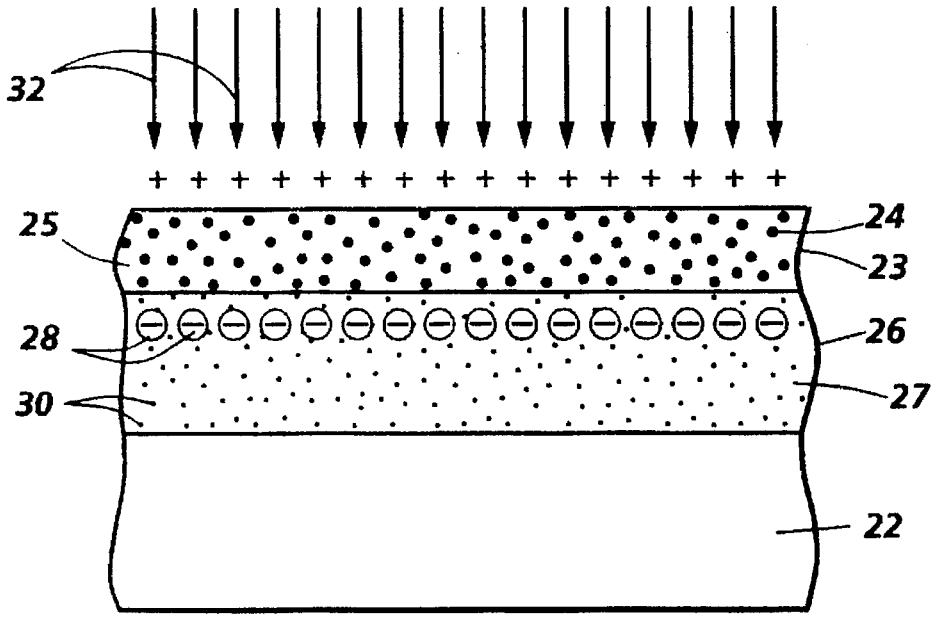

As illustrated schematically in FIGS. 10A and 10B, the charged member illustrated schematically in FIGS. 7A and 7B is first exposed uniformly to activating radiation 32 at a wavelength to which the migration marking material 28 is sensitive. For example, when the migration marking material is selenium particles, blue or green light can be used for uniform exposure. As shown in FIG. 10A, when layer 26 is situated above layer 23, the uniform exposure to radiation 32 results in absorption of radiation by the migration marking material 28. The migration marking particles 28 acquire a negative charge as ejected holes (positive charges) discharge the surface negative charges. As shown in FIG. 10B, when layer 23 is situated above layer 26, uniform exposure to activating radiation 32 at a wavelength to which the migration marking material is sensitive results in substantial photodischarge as the photogenerated charges (holes in this instance) in the migration marking particles are ejected out of the particles and transported to the substrate. As a result, the migration marking particles acquire a negative charge as shown schematically in FIG. 10B.

Figure 11A:
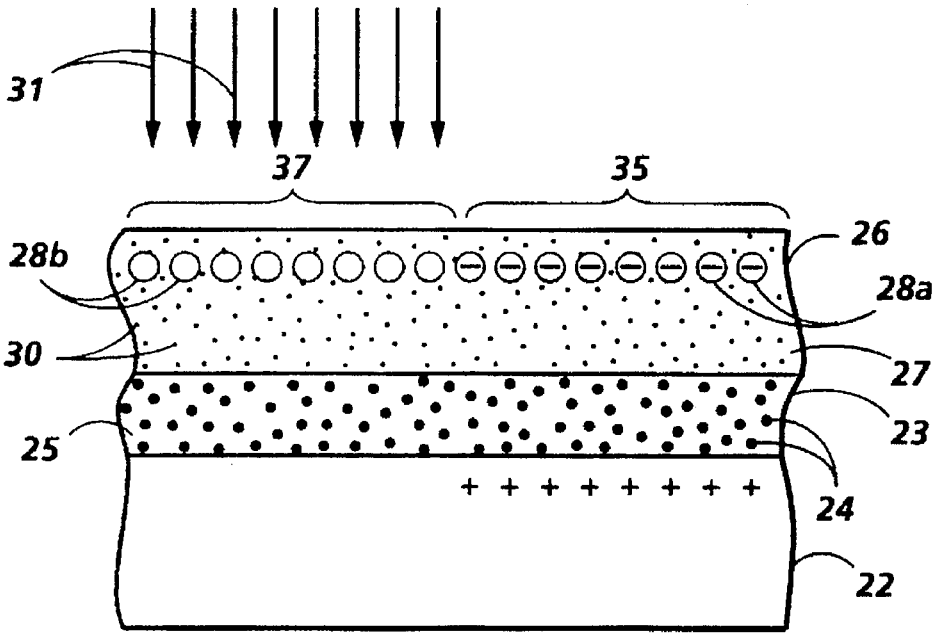
Figure 11B:
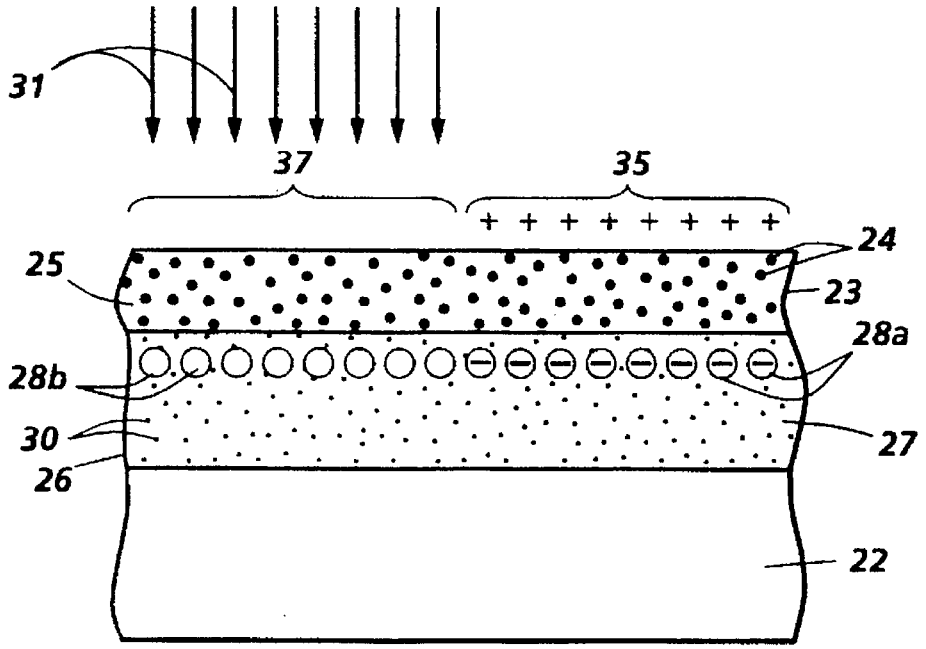
Figure 11C:
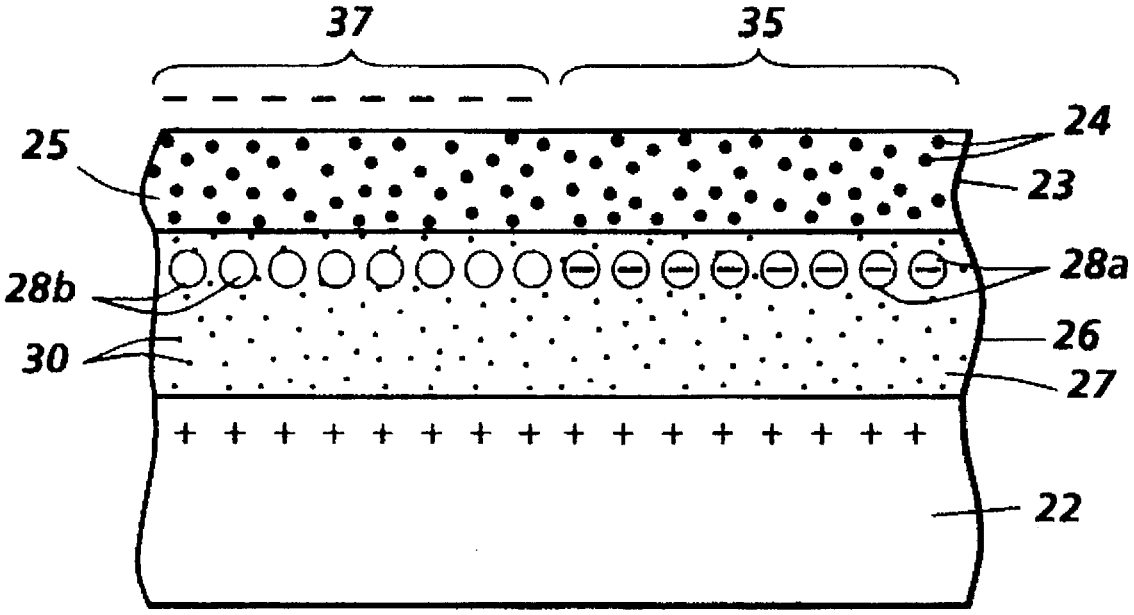

As illustrated schematically in FIGS. 11A, 11B, and 11C, the charged member is subsequently exposed imagewise to infrared or red light radiation 31. As shown in FIG. 11A, when the softenable layer 26 is situated between the infrared or red light sensitive layer 23 and the radiation source 31, the infrared or red light radiation 31 passes through the non-absorbing migration marking material 28 (which is selected to be insensitive to the infrared or red light radiation wavelength used in this step) and exposes the infrared or red light sensitive pigment particles 24 in the infrared or red light sensitive layer, thereby discharging the migration marking particles 28*b* in area 37 that are exposed to infrared or red light radiation and leaving the migration marking particles 28*a* charged in areas 35 not exposed to infrared or red light radiation. As shown in FIG. 11B, when layer 23 is situated above layer 26, and the charged member is subsequently imagewise exposed to infrared or red light radiation 31, absorption of the infrared or red light by layer 23 in the exposed areas results in photogeneration of electrons and holes which neutralize the positive surface charge and the negative charge in the migration marking particles.

In the embodiment illustrated in FIG. 11B, the resulting charge pattern is such that the imaging member cannot be developed by heat development, since there is no substantial electric field between the migration marking materials and the substrate. As shown schematically in FIG. 11C, the imaging member is further subjected to uniform recharging to a polarity opposite to that which the charge transport material in the softenable layer is capable of transporting (negative as illustrated in FIG. 11C), resulting in the migration marking material in areas of the imaging member which has not been exposed to infrared or red light radiation becoming negatively charged, with an electric field between the migration marking particles and the substrate, and areas of the imaging member previously exposed to infrared or red light radiation becoming charged only on the surface of the member. The charge image pattern obtained after the processes illustrated schematically in FIGS. 10A and 10B and FIGS. 11A, 11B, and 11C is thus identical to the one obtained after the processes illustrated schematically in FIGS. 8A and 8B and FIGS. 9A, 9B, and 9C.

As illustrated schematically in FIGS. 12A and 12B, subsequent to formation of a charge image pattern, the imaging member is simultaneously overcoated and developed by causing the softenable material to soften by laying overcoating layer 40 onto the surface of the imaging member spaced from substrate 22 (in the embodiment illustrated in FIG. 12A, laying overcoating layer 40 onto the surface of softenable layer 26, and in the embodiment illustrated in FIG. 12B, laying overcoating layer 40 onto the surface of infrared or red-light sensitive layer 23) and applying heat and pressure to the migration imaging member and overcoating layer by passing the "sandwich" created by laying overcoating layer 40 onto the imaging member through a nip created by roller 42 and roller 43. Heating can be accomplished by heating one or both of rollers 42 and 43. Alternatively (not shown), a heating element may be situated so as to heat the "sandwich" before it passes through the nip created by rollers 42 and 43. Rollers 42 and 43 are situated with respect to each other so as to form a nip, such that pressure is applied to the imaging member and overcoating layer 40 while they are in intimate contact with each other. Thereafter, subsequent to exiting the nip formed by rollers 42 and 43, overcoating layer 40 adheres to the surface of the imaging member. Application of heat and pressure in the illustrated manner causes softenable material 27 to soften, thereby enabling migration marking material 28 to migrate through softenable material 27 toward substrate 22. In the embodiment illustrated in FIG. 12A, softening of softenable material 27 also causes overcoating layer 40 to adhere to softenable layer 26. In the embodiment illustrated in FIG. 12B, the applied heat and pressure also causes overcoating layer 40 to adhere to infrared or red-light sensitive layer 23. When no optional adhesive layer is situated between overcoating layer 40 and infrared or red-light sensitive layer 23, the material of infrared or red-light sensitive layer 23 is selected so that its glass transition temperature is such that application of the desired heat and pressure cause layer 23 to soften sufficiently to enable it to adhere to overcoating layer 40 subsequent to exiting the nip formed by rollers 42 and 43. The temperature and time depend upon factors such as the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 27 decreases in viscosity, thereby decreasing its resistance to migration of the marking material 28 through the softenable layer 26. As shown in FIG. 12A, when layer 26 is situated above layer 23, in areas 35 of the imaging member, wherein the migration marking material **28*a* has a substantial net charge, upon softening of the softenable material 27, the net charge causes the charged marking material to migrate in image configuration towards the conductive layer 22 and disperse or agglomerate in the softenable layer 26, resulting in a $D_{min}$ area. The uncharged migration marking particles 28*b* in areas 37 of the imaging member remain essentially neutral and uncharged. Thus, in the absence of migration force, the unexposed migration marking particles remain substantially in their original position in softenable layer 26, resulting in a $D_{max}$ area. As shown in FIG. 12B, in the embodiment wherein layer 23 is situated above layer 26 and the member was charged in step 7B to the same polarity as that which the charge transport material in the softenable layer is capable of transporting and in which the member has been recharged as shown in FIG. 9C or 11C to the polarity opposite to that which the charge transport material in the softenable layer is capable of transporting, the migration marking particles that are charged (those not exposed to infrared or red light radiation) migrate in depth toward the substrate 22 and disperse or agglomerate in softenable layer 26, resulting in a $D_{min}$ area. The uncharged migration marking particles 28*b* in areas 37 of the imaging member remain essentially neutral and uncharged. Thus, in the absence of migration force, the unexposed migration marking particles remain substantially in their original positions in softenable layer 26**, resulting in a $D_{max}$ area.

The application of heat should be sufficient to decrease the resistance of the softenable material 27 of softenable layer 26 to allow migration of the migration marking material 28 through softenable layer 26 in imagewise configuration. The test for a satisfactory combination of time and temperature is to maximize optical contrast density. The temperature and the pressure in the nip created by rollers 42 and 43 is selected so that overcoating layer 40 adheres to whichever layer is situated topmost on substrate 22 (which is softenable layer 26 as illustrated in FIG. 12A and infrared or red-light sensitive layer 23 as illustrated in FIG. 12B) subsequent to exiting the nip. Preferred temperatures for heating typically are from about 70° to about 150° C., and more preferably from about 85° C. to about 110° C., although the temperature can be outside these ranges. Preferred pressures within the nip between rollers 42 and 43 typically are from about 0.1 to about 50 pounds per square inch, although the pressure can be outside this range.

The imaging members illustrated in FIGS. 7A and 7B through 12A and 12B are shown without any optional layers such as those illustrated in FIGS. 2 and 3. If desired, alternative imaging member embodiments, such as those employing any or all of the optional layers illustrated in FIGS. 2 and 3, can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A migration imaging member was prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto a 3 mil thick polyester substrate (Melinex 442, obtained from Imperial Chemical Industries (ICI), aluminized to 20 percent light transmission), and the deposited softenable layer was allowed to dry at about 115° C. for about 2 minutes, resulting in a dried softenable layer with a thickness of about 4 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer layer was formed, The surface of the member thus formed was uniformly negatively charged to a surface potential of −142 Volts with a corona charging device and was subsequently optically exposed by placing a test pattern mask comprising a silver halide image in contact with the imaging member and exposing the member to blue light of 480 nanometers through the mask for a period of 5 seconds (corresponding to 32 ergs per square centimeter). The imaging member was then inserted into a 6 mil thick laminating pouch consisting of two overcoating layers and an adhesive material (obtained from Southwest Bindings, Scarborough, Ontario, Canada). No visible image was present on or in the imaging member at this point. The pouch containing the imaging member was then passed through a CardGuard laminator (obtained from Southwest Bindings, Scaraborough, Ontario) set to 300° F. In this apparatus, heating elements situated above and below the pouch heated the pouch prior to its entry into the nip created by the pressure rollers. A second set of rollers also created a nip through which the pouch passed prior to being heated. Subsequent to passing through the laminator, an overcoated migration imaging member emerged in which a developed image was visible. The overcoating layer greatly improved the scratch resistance of the imaging member without any substantial impairment of the optical contrast density of the member. Prior to lamination, the optical density in the blue region of the $D_{max}$ areas of the pouch was 1.98. Subsequent to lamination, the optical density of the $D_{max}$ areas of the pouch was about 1.69 and the optical density of the $D_{min}$ areas of the pouch was about 0.88. For comparison purposes, the optical density of a pouch containing no imaging member and consisting solely of the overcoating layers and the adhesive material was also measured, and was 0.08 prior to lamination and 0.02 subsequent to lamination.

EXAMPLE II

The procedure of Example I was repeated except that the laminator was set to a temperature of 250° F. Substantially similar results were obtained. Specifically, the optical density in the blue region of the $D_{max}$ areas of the pouch prior to lamination was 1.97, and subsequent to lamination the $D_{max}$ areas of the pouch had an optical density of 0.97 and the $D_{min}$ areas of the pouch had an optical density of 0.83.

EXAMPLE III

An infrared-sensitive migration imaging member was prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto a 3 mil thick polyester substrate (Melinex 442, obtained from Imperial Chemical Industries (ICI), aluminized to 20 percent light transmission), and the deposited softenable layer was allowed to dry at about 115° C. for about 2 minutes, resulting in a dried softenable layer with a thickness of about 2 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer layer was formed.

The migration imaging member thus formed was then treated as follows. A pigment dispersion was prepared by ball milling for 24 hours a mixture comprising 10.6 parts by weight solids in a solvent (wherein the solvent comprised 40 percent by weight 2-propanol and 60 percent by weight deionized water), wherein the solids comprised 20 percent by weight X-metal-free phthalocyanine (prepared as described in U.S. Pat. No. 3,357,989 (Byrne et al.), the disclosure of which is totally incorporated by reference) and 80 percent by weight of a styrene-butyl methacrylate copolymer (ICI Neocryl A622). The resulting dispersion was hand coated onto the softenable layer of the migration imaging member with a #5 Meyer rod, followed by drying the deposited infrared-sensitive layer at 50° C. for 1 minute by contacting the polyester substrate to an aluminum heating block.

The infrared-sensitive migration imaging member thus prepared was imaged as follows. The surface of the member was uniformly positively charged to with a corona charging device and was subsequently exposed by placing a test pattern mask comprising a silver halide image in contact with the imaging member and exposing the member to infrared light of 773 nanometers through the mask for a period of 20 seconds (corresponding to 260 ergs per square centimeter). The exposed member was subsequently uniformly exposed to 490 nanometer light for a period of 10 seconds (corresponding to 53 ergs per square centimeter) and thereafter uniformly negatively recharge with a corona charging device. The imaging member was then inserted into a 6 mil thick laminating pouch consisting of two overcoating layers and an adhesive material (obtained from Southwest Bindings, Scaraborough, Ontario, Canada). No visible image was present on or in the imaging member at this point. The pouch containing the imaging member was then passed through a Card Guard laminator (obtained from Southwest Bindings, Scaraborough, Ontario set to 250° F. In this apparatus heating elements situated above and below the pouch heated the pouch prior to its entry into the nip created by the pressure rollers. A second set of rollers also created a nip through which the pouch passed prior to being heated. Subsequent to passing through the laminator, an overcoated migration imaging member emerged in which a developed image was visible. The overcoating layer greatly improved the scratch resistance of the imaging member without any substantial impairment of the optical contrast density of the member. Prior to lamination, the optical density in the blue region of the $D_{max}$ areas of the pouch was 1.54. Subsequent to lamination, the optical density of the $D_{max}$ areas of the pouch was 1.15 and the optical density of the $D_{min}$ areas of the pouch was about 1.05.

EXAMPLE IV

The developed and overcoated imaging member prepared as described in Example I was placed on top of a Viking G2 photosensitive offset printing plate, obtained from Canadian Fine Color, and used as a mask for exposure. The plate was exposed through the overcoated imaged member with an 1800 Watt press plate bulb in a standard exposure station obtained from Douthitt, Detroit, Mich., for a period of 120 seconds. The plate was then developed, resulting in an imaged offset plate bearing the image from the developed and overcoated migration imaging member.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (1) providing a migration imaging member comprising a substrate and a softenable layer comprising a softenable material and a photosensitive migration marking material; (2) uniformly charging the imaging member; (3) subsequent to step (2), exposing the charged imaging member to activating radiation at a wavelength to which the migration marking material is sensitive; (4) subsequent to step (3), applying to the surface of the migration imaging member spaced from the substrate a substantially transparent overcoating layer and applying heat and pressure to the migration imaging member and overcoating layer, thereby causing the softenable material to soften and enabling the migration marking material to migrate through the softenable material toward the substrate in an imagewise pattern, while substantially simultaneously causing the overcoating layer to adhere to the imaging member surface.

2. A process according to claim 1 wherein the migration marking material is selenium.

3. A process according to claim 1 wherein the marking material is present in the softenable layer as a monolayer of particles situated at or near the surface of the softenable layer spaced from the substrate.

4. A process according to claim 1 wherein the migration imaging member comprises a substrate, a first softenable layer comprising a first softenable material and a first migration marking material contained at least at or near the surface of the first softenable layer spaced from the substrate, and a second softenable layer comprising a second softenable material and a second migration marking material.

5. A process according to claim 1 wherein the softenable layer contains a charge transport material.

6. A process according to claim 5 wherein the migration imaging member also comprises an infrared or red light radiation sensitive layer which comprises a pigment predominantly sensitive to infrared or red light radiation, wherein the migration marking material is predominantly sensitive to radiation at a wavelength other than that to which the infrared or red light sensitive pigment is sensitive.

7. A process according to claim 6 wherein the infrared or red light radiation sensitive layer is situated between the substrate and the softenable layer.

8. A process according to claim 6 wherein the softenable layer is situated between the substrate and the infrared or red light radiation sensitive layer.

9. A process according to claim 6 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

10. A process according to claim 1 wherein the substantially transparent overcoat layer has a thickness of from about 0.2 to about 2.5.

11. A process according to claim 1 wherein heat is applied at a temperature of from about 70° to about 150° C.

12. A process according to claim 1 wherein the pressure applied is from about 0.1 to about 50 pounds per square inch.

* * * * *